US011421451B2

(12) United States Patent
Patane et al.

(10) Patent No.: US 11,421,451 B2
(45) Date of Patent: Aug. 23, 2022

(54) CLOSURE LATCH ASSEMBLY FOR MOTOR VEHICLE HAVING COMMON KINEMATIC CHAIN FOR POWER RELEASE MECHANISM AND MECHANICAL BACKUP RELEASE MECHANISM

(71) Applicant: MAGNA CLOSURES INC., Newmarket (CA)

(72) Inventors: Francesco Patane, Newmarket (CA); Enrico Boeri, Camaiore (IT); Carlo Quartieri, Pontedera (IT)

(73) Assignee: MAGNA CLOSURES INC., Newmarket (CA)

( * ) Notice: Subject to any disclaimer, the term of this patent is extended or adjusted under 35 U.S.C. 154(b) by 652 days.

(21) Appl. No.: 16/275,980

(22) Filed: Feb. 14, 2019

(65) Prior Publication Data

US 2019/0249467 A1 Aug. 15, 2019

Related U.S. Application Data

(60) Provisional application No. 62/630,889, filed on Feb. 15, 2018.

(51) Int. Cl.
*E05B 81/16* (2014.01)
*E05B 81/64* (2014.01)
(Continued)

(52) U.S. Cl.
CPC ..... *E05B 81/16* (2013.01); *E05B 79/20* (2013.01); *E05B 81/36* (2013.01); *E05B 81/64* (2013.01);
(Continued)

(58) Field of Classification Search
CPC ..... E05B 81/16; E05B 79/20; E05B 81/90; E05B 79/06; E05B 81/64; E05B 81/76; E05B 81/34
See application file for complete search history.

(56) References Cited

U.S. PATENT DOCUMENTS 4,875,723 A * 10/1989 Compeau ..... E05B 81/14 292/201
5,000,495 A 3/1991 Wolfgang et al.
(Continued)

FOREIGN PATENT DOCUMENTS

CN 1856630 A 11/2006
CN 103089087 A 5/2013
(Continued)

OTHER PUBLICATIONS

Baert, D.H.J. (1999). Hall Effect Transducers. In Wiley Encyclopedia of Electrical and Electronics Engineering, J.G. Webster (Ed.). https://doi.org/10.1002/047134608X.W3952 (Year: 1999).*
(Continued)

*Primary Examiner* — Kristina R Fulton
*Assistant Examiner* — Emily G. Brown
(74) *Attorney, Agent, or Firm* — Dickinson Wright PLLC

(57) ABSTRACT

A closure latch assembly for a motor vehicle closure panel is equipped with a common kinematic chain of components for a latch release mechanism utilizing a first range of handle travel to initiate a power release of a latch mechanism and further utilizing a second range of handle travel to initiate a mechanical release of the latch mechanism. An actuation rod may include a magnet that, when moved out of range of a sensor, signals to initiate the power release. In the event that the power release does not occur, further movement of the actuation rod forces the mechanical release. In both the power release and mechanical release, a pawl is rotated from a ratchet holding position to a ratchet release position.

20 Claims, 24 Drawing Sheets

(51) Int. Cl.
*E05B 79/20* (2014.01)
*E05B 81/36* (2014.01)
*E05B 81/90* (2014.01)

(52) U.S. Cl.
CPC ..... *E05B 81/90* (2013.01); *E05Y 2900/531* (2013.01)

(56) References Cited

U.S. PATENT DOCUMENTS

| | | | | |
|---|---|---|---|---|
| 6,523,376 | B2 * | 2/2003 | Baukholt | E05B 81/14 292/201 |
| 6,698,262 | B2 * | 3/2004 | Wittwer | E05B 85/107 70/208 |
| 7,827,836 | B2 | 11/2010 | Cetnar | |
| 7,866,714 | B2 * | 1/2011 | Monig | E05B 81/76 292/336.3 |
| 8,528,949 | B2 * | 9/2013 | Katsumata | E05B 81/14 292/201 |
| 8,596,696 | B2 * | 12/2013 | Cumbo | E05B 85/26 292/216 |
| 9,926,727 | B2 * | 3/2018 | Kouzuma | E05B 81/34 |
| 10,214,945 | B2 | 2/2019 | Cetnar | |
| 2011/0074170 | A1 | 3/2011 | Tomaszewski et al. | |
| 2012/0313384 | A1 * | 12/2012 | Gumbo | E05B 81/70 292/199 |
| 2015/0191944 | A1 * | 7/2015 | Kouzuma | E05B 81/90 292/336.3 |
| 2016/0138307 | A1 | 5/2016 | Pohl et al. | |
| 2018/0163439 | A1 | 6/2018 | Patane et al. | |
| 2018/0355642 | A1 | 12/2018 | Cumbo et al. | |
| 2018/0355643 | A1 | 12/2018 | Taurasi | |

FOREIGN PATENT DOCUMENTS

| | | | | |
|---|---|---|---|---|
| CN | 203476012 | U | 3/2014 | |
| CN | 105089382 | A | 11/2015 | |
| DE | 202008003845 | U1 | 8/2009 | |
| EP | 0589158 | A1 | 3/1994 | |
| FR | 2783550 | A1 * | 3/2000 | E05B 77/34 |

OTHER PUBLICATIONS

"Rod." Lexico.com Dictionary, Lexico, https://www.lexico.com/en/definition/rod, accessed Jan. 5, 2022 (Year: 2022).*

Baert, D.H.J., Hall Effect Transducers, Wiley Encyclopedia of Electrical and Electronics Engineering (1999) (available at: https://doi.org/10.1002/047134608X.W3952) (Year: 1999).*

* cited by examiner

CLOSURE LATCH ASSEMBLY FOR MOTOR VEHICLE HAVING COMMON KINEMATIC CHAIN FOR POWER RELEASE MECHANISM AND MECHANICAL BACKUP RELEASE MECHANISM

CROSS-REFERENCE TO RELATED APPLICATIONS

This application claims the benefit of U.S. Provisional Patent Application No. 62/630,889, filed Feb. 15, 2018, titled "Closure Latch Assembly for Motor Vehicle Having Common Kinematic Chain for Power Release Mechanism and Mechanical Backup Release Mechanism," the entire content of which is hereby incorporated by reference in its entirety.

FIELD

The present disclosure relates generally to a closure latch assembly for motor vehicles. More particularly, the present disclosure is directed to such a closure latch assembly having a common kinematic chain for power release and mechanical backup release of a latch mechanism.

BACKGROUND

This section provides background information related to motor vehicle closure systems and is not necessarily prior art to the closure latch assembly of the present disclosure.

In view of increased consumer demand for motor vehicles equipped with advanced comfort and convenience features, many modern motor vehicles are now provided with passive entry systems to permit locking and release of closure panels (i.e., doors, tailgates, liftgates and decklids) without use of a traditional key-type entry system. In this regard, one popular feature now available with vehicle latch systems includes a power release function. The power release function is provided by a closure latch assembly mounted to the closure panel and equipped with a ratchet and pawl type of latch mechanism controlled via an electric actuator. Typically, the closure panel is held in a closed position by virtue of the ratchet being held in a striker capture position to releaseably retain a striker that is mounted to a structural portion of the vehicle. In most ratchet and pawl type of latch mechanisms, the pawl is operable in a ratchet holding position to engage and hold the ratchet in its striker capture position. To subsequently release the closure panel from its closed position, a latch release mechanism is actuated via the electric actuator for moving the pawl from its ratchet holding position into a ratchet releasing position, whereby a ratchet biasing arrangement, in conjunction with any door seal loads, forcibly pivots the ratchet from its striker capture position into a striker release position so as to release the striker.

In such closure latch assemblies equipped with a power-operated latch release mechanism, there is also a requirement to employ a mechanical or "backup" latch release mechanism which can be actuated via a door handle in the event power is lost to the electric actuator. Conventionally, the backup latch release mechanism is coupled to the door handle via a Bowden cable such that pulling on the door handle actuates the backup latch release mechanism for causing the pawl to be moved to its ratchet releasing position. In most closure latch assemblies, the backup latch release mechanism has a dedicated kinematic chain that is distinct and uncoupled from the kinematic chain associated with the power-operated latch release mechanism. The integration of two distinct latch release mechanisms into the closure latch assembly requires adequate packaging space and results in increased cost and operational complexity.

While current closure latch assemblies with power release functionality are sufficient to meet regulatory requirements and provide enhanced operational convenience, a need still exists to advance the technology and provide alternative arrangements that address and overcome at least some of the known shortcomings.

SUMMARY

This section provides a general summary of the disclosure and is not intended to be a comprehensive disclosure of its full scope or all of its features, aspects, advantages and objectives.

It is an aspect of the present disclosure to provide a closure latch assembly for use in a swing-type side door of a motor vehicle and which is equipped with a power-operated latch release mechanism and a mechanically-operated latch release mechanism sharing a common kinematic chain for selectively releasing a latch mechanism.

It is a related aspect of the present disclosure to arrange the common kinematic chain to include a dual-stage cable-actuated configuration connecting a door handle to an actuation rod via a bowden cable. Movement of the door handle from a rest position to a first release position causes movement of the actuation rod from a non-actuated position to a first actuated position for triggering actuation of the power-operated latch release mechanism to provide a power release function. Movement of the door handle from its first release position to a second release position causes movement of the actuation rod from its first actuated position to a second actuated position for triggering actuation of the mechanically-operated latch release mechanism to provide a manual release function.

In another related aspect, movement of the actuation rod from its non-actuated position to its first actuated position functions to activate a release switch sensor, embedded within the closure latch assembly, for triggering actuation of the power-operated latch release mechanism. A magnet mounted to the moveable actuation rod is used to activate the release switch sensor, which is preferably configured as a Hall sensor.

In another aspect, a closure latch assembly for a vehicle door is provided. The assembly includes a latch mechanism having a ratchet moveable between a striker capture position and a striker release position, a pawl moveable between a ratchet holding position for holding the ratchet in its striker capture position and a ratchet releasing position for permitting movement of the ratchet to its striker release position, a ratchet biasing member for biasing the ratchet toward its striker release position, and a pawl biasing member for biasing the pawl toward its ratchet holding position.

The closure latch assembly further includes a latch release mechanism operatively connected to the pawl, a power-operated actuator operable to shift the latch release mechanism from a rest position whereat the pawl is located in its ratchet holding position to an actuated position whereat the latch release mechanism has moved the pawl to its ratchet releasing position, an actuation linkage operatively connected to the pawl, and a connection device operatively connecting the actuation linkage to a door handle, wherein movement of the door handle from a handle rest position to a first handle release position causes movement of the actuation linkage from a non-actuated position into a first actuated position whereat the power-operated actuator is activated to shift the latch release mechanism from its rest position to its actuated position, and wherein movement of the door handle from its first handle release position to a second handle release position causes movement of the actuation linkage from its first actuated position into a second actuated position for causing the actuation linkage to mechanically move the pawl from its ratchet holding position into its ratchet releasing position.

In yet another aspect, a closure latch assembly for a vehicle is provided. The closure latch assembly includes a latch mechanism having a ratchet moveable between a striker capture position and a striker release position, the ratchet biased toward the striker release position; a pawl moveable between a ratchet holding position for holding the ratchet in its striker capture position and a ratchet releasing position for permitting movement of the ratchet to its striker release position, the pawl biased to the ratchet holding position; a latch release mechanism having a gear configured to act on the pawl to move the pawl from the ratchet holding position to the ratchet releasing position; a power-operated actuator operable to rotate the gear from a gear rest position whereat the pawl is located in its ratchet holding position to a gear actuated position whereat the gear has moved the pawl to its ratchet releasing position, an actuation linkage configured to act on the pawl to move the pawl from the ratchet holding position to the ratchet release position, the actuation linkage moveable from a rest position, a first actuation position, and a second actuation position; a sensor associated with the actuation linkage, wherein, when the sensor operates in a normal mode, the sensor is configured to signal when the actuation linkage is in the first actuation position, and rotation of the gear causes movement of the pawl; wherein, movement of the actuation linkage from its first actuated position into a second actuated position causes the actuation linkage to mechanically move the pawl from its ratchet holding position into its ratchet releasing position.

In another aspect, a method for actuating a latch assembly is provided. The method includes providing a latch assembly having a ratchet, a pawl, an electrically actuatable gear, and an actuation linkage; wherein the ratchet has a striker capture position and a striker release position, the ratchet being biased to the striker release position; wherein the pawl has a ratchet holding position and a ratchet release position, wherein the pawl is biased toward the ratchet holding position; wherein the electrically actuatable gear has a rest position and an actuated position, the gear being electrically actuatable from the rest position to the actuated position; wherein the actuation linkage has a rest position, a first actuated position, and a second actuated position; moving the actuation linkage from the rest position to the first actuated position, and then from the first actuated position to the second actuated position; moving the pawl from the ratchet holding position to the ratchet release position; in response thereto, moving the ratchet from the striker capture position to the striker release position; wherein the pawl is moveable in both a normal mode and a backup mode, wherein in the normal mode, the pawl is actuated by moving the gear in response to moving the actuation linkage to the first actuated position, and in the backup mode the pawl is actuated in response to moving the actuation linkage to the second actuated position after moving the actuation linkage to the first actuated position.

These and other aspects of the present disclosure are provided by a closure latch assembly comprising: a latch mechanism having a ratchet moveable between a striker capture position and a striker release position; a ratchet biasing member for biasing the ratchet toward its striker release position; a pawl moveable between a ratchet holding position for holding the ratchet in its striker capture position and a ratchet releasing position for permitting movement of the ratchet to its striker release position; a pawl biasing member for biasing the pawl toward its ratchet holding position; a power-operated latch release mechanism having a power release gear operatively connected to the pawl and a power release actuator operable to rotate the power release gear between a gear rest position whereat the pawl is located in its ratchet holding position and a gear actuated position whereat the pawl is moved to its ratchet releasing position; and a manually-operated latch release mechanism having an actuation rod operatively connected to a door handle via a bowden cable, wherein movement of the door handle from a handle rest position to a first handle release position causes the actuation rod to move from a non-actuated position to a first actuated position whereat the power release actuator is activated to rotate the power release gear from its gear rest position to its gear actuated position to provide a power release function, and wherein movement of the door handle to a second handle release position causes the actuation rod to move to a second actuated position whereat the actuation rod moves the pawl from its ratchet holding position to its ratchet releasing position to provide a manual release function.

These and other aspects of the present disclosure are provided by a closure latch assembly comprising: a latch mechanism having a ratchet moveable between a striker capture position and a striker release position, a pawl moveable between a ratchet holding position for holding the ratchet in its striker capture position and a ratchet releasing position for permitting movement of the ratchet to its striker release position, a ratchet biasing member for biasing the ratchet toward its striker release position, and a pawl biasing member for biasing the pawl toward its ratchet holding position; and a latch release mechanism having a gear operatively connected to the pawl, a power-operated actuator operable to rotate the gear from a gear rest position whereat the pawl is located in its ratchet holding position to a gear actuated position whereat the gear has moved the pawl to its ratchet releasing position, an actuation rod operatively connected to the pawl, and a connection device operatively connecting the actuation rod to a door handle, wherein movement of the door handle from a handle rest position to a first handle release position causes movement of the actuation rod from a non-actuated position into a first actuated position whereat the power-operated actuator is activated to rotate the gear from its gear rest position to its gear actuated position, and wherein movement of the door handle from its first handle release position to a second handle release position causes movement of the actuation rod from its first actuated position into a second actuated position for causing the actuation rod to mechanically move the pawl from its ratchet holding position into its ratchet releasing position.

Further areas of applicability will become apparent from the description provided herein. The description and specific embodiment disclosed in this summary are not intended to limit the scope of the present disclosure.

DRAWINGS

The foregoing and other aspects of the present disclosure will now be described by way of non-limiting examples with reference to the attached drawings in which.

Corresponding reference numerals are used throughout the several views of the drawings to indicate corresponding components unless otherwise indicated.

DETAILED DESCRIPTION

Example embodiments of closure latch assemblies are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

Figure 1:
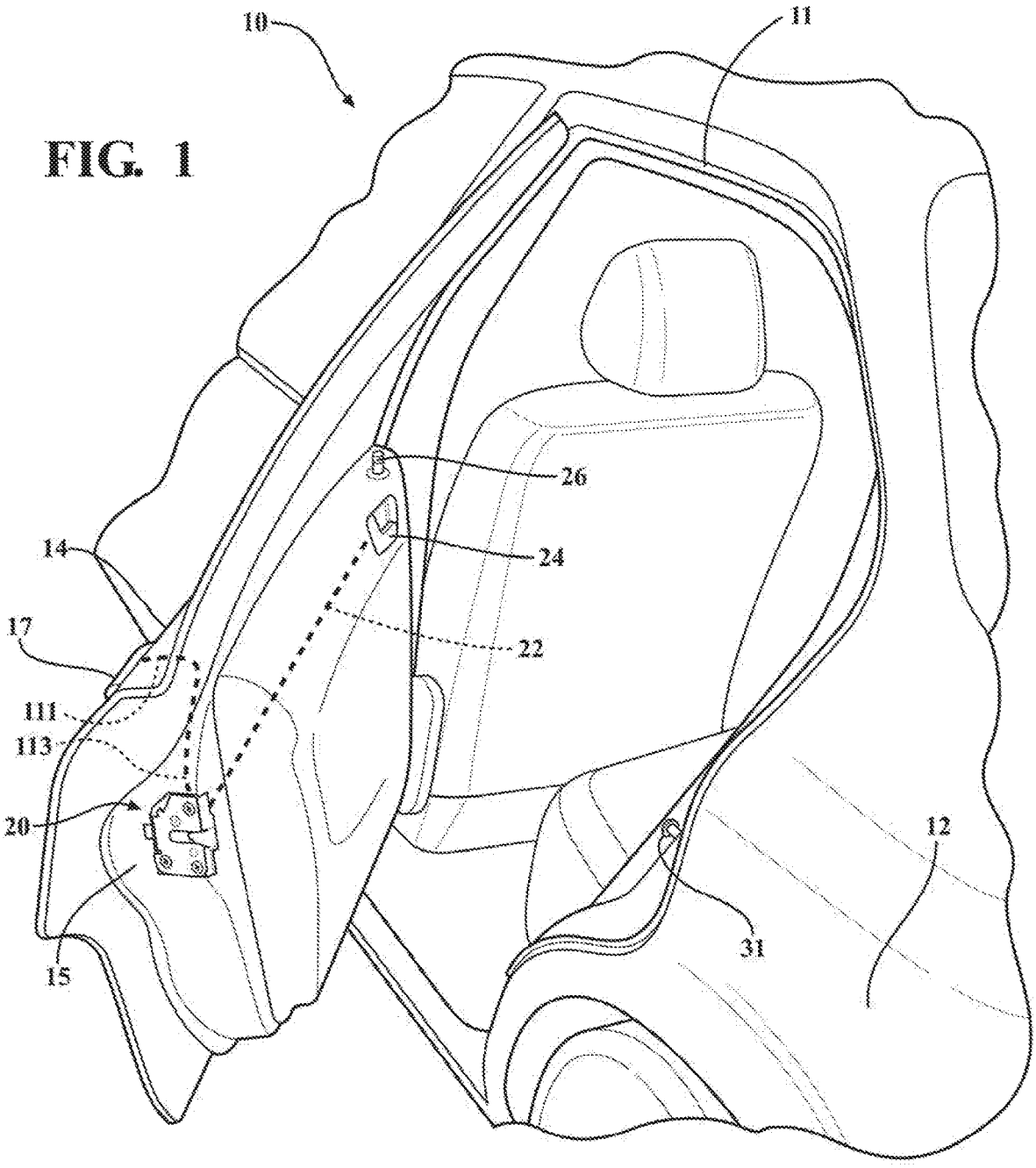
FIG. 1 is a partial isometric view of a motor vehicle equipped with a door having a closure latch assembly constructed in accordance with the present disclosure.

FIG. 1 is a partial isometric view of a motor vehicle 10 having a vehicle body 12 and at least one closure member, shown as vehicle passenger door 14, by way of example and without limitation. Vehicle door 14 is hinged to vehicle body 12 for movement between closed and open positions. Vehicle door 14 includes an inside door handle 24, an outside door handle 17, a lock knob 26, and a closure latch assembly 20 positioned on an edge face 15 of door 14. A connection device, such as a bowden cable 22, is shown operatively interconnecting closure latch assembly 20 to inside handle 16. It is also recognized that connection device, such as the bowden cable 22A, may be alternatively or additionally operatively interconnect closure latch assembly 20 to outside handle 17. As will be detailed, closure latch assembly 20 includes a latch mechanism configured to releasably latch a striker 31 fixed to vehicle body 12, a power-operated latch release mechanism configured to selectively release the latch mechanism, and a handle-actuated latch release mechanism configured to connect inside door handle 16 to the latch mechanism. However, it should be understood that the particular construction of these specific mechanisms is not critical or limiting to the present disclosure which relates to integration of a common kinematic chain between the components of the handle-actuated latch release mechanism and the components of the power-operated latch release mechanism.

While the closure member is illustrated as a passenger door 14, it is to be understood that closure latch assembly 20 to be described can likewise be adapted for use with alternative closure members such as, and without limitation, liftgates, tailgates, hatch doors, sliding doors, trunk lids and engine compartment hoods.

Referring now to FIGS. 2 through 10, a first non-limiting embodiment of closure latch assembly 20 will be described to clearly identify and define the inventive concepts embodied therein. In general, closure latch assembly 20 includes a latch housing 40 defining a fishmouth striker entry channel 42, a latch mechanism 44, a power-operated latch release mechanism 46, a reset mechanism 48, an optional power-operated cinch mechanism 52, and an inside (IS) backup latch release mechanism 54.

Latch mechanism 44 includes a ratchet 60 mounted via a ratchet pivot post 62 to latch housing 40 for pivotal movement between a striker capture position (FIG. 3) and a striker release position, a ratchet biasing member (identified by arrow 64) for normally biasing ratchet 60 toward its striker release position, a pawl 70 mounted to latch housing 40 via a pawl pivot post 72 for pivotal movement between a ratchet holding position (FIG. 3) and a ratchet releasing position (FIG. 8), and a pawl biasing member (identified by arrow 74) for normally biasing pawl 70 toward its ratchet holding position.

With ratchet 60 held in its striker capture position by pawl 70 being located in its ratchet holding position, latch mechanism 44 defines a latched state such that closure latch assembly 20 is operating in a latched mode. As such, striker 31 (mounted to vehicle body 12) is held in a guide channel 80 formed in ratchet 60 to hold door 14 in its closed position. In contrast, movement of ratchet 60 to its striker release position upon movement of pawl 70 to its ratchet releasing position defines a released state for latch mechanism 44 such that closure latch assembly 20 is operating in an unlatched mode. With ratchet 60 located in its striker release position, striker 31 (mounted to vehicle body 12) can be discharged from striker guide channel 80 in ratchet 60 and allow door 14 to be swung to its open position.

Upon subsequent closure of door 14, striker 31 engages guide channel 80 and forcibly rotates ratchet 60 into its striker capture position, in opposition to the biasing of ratchet biasing member 64. With ratchet 60 again located in its striker capture position, pawl 70 moves into its ratchet holding position such that a pawl engagement lug 82 engages a primary locking notch 84 formed on ratchet 60, whereby closure latch assembly 20 is shifted into its latched mode with door 14 held in the closed position. Movement of pawl 70 to its ratchet releasing position, via actuation of power-operated latch release mechanism 46 or IS latch release mechanism 54, permits ratchet biasing member 64 to drive ratchet 60 to its striker release position.

Power-operated latch release mechanism 46 is operable to move pawl 70 from its ratchet holding position into its ratchet releasing position when the release of latch mechanism 44 is desired. Power-operated latch release mechanism 46 generally includes a power release (PR) member configured as a gear 90 rotatably mounted via a gear pivot post 92 to latch housing 40, and a power release actuator for controlling rotation of PR gear 90. The power release actuator includes an electric motor 94 and a gearset 96 having a drive pinion 98 driven by a rotary output of electric motor 94 and a sector gear 100 formed on PR gear 90 that is meshed with drive pinion 98. PR gear 90 also includes a contoured drive slot 102 configured to selectively engage a first pawl drive lug 104 extending upwardly from pawl 70. PR gear 90 further includes a raised cam segment 106. As will be detailed, rotation of gearset 96 in a first direction results in rotation of PR gear 90 about a rotary axis established by gear pivot post 92 in a first or "releasing" direction (counterclockwise in FIGS. 2-10) through a first range of travel and defining a plurality of sequential positions including and without limitations, a rest position (FIG. 3), an end of pretravel or a pawl engage position (FIG. 4), a series of intermediate positions (FIGS. 5-7), a pawl release position (FIG. 8), an on-center position (FIG. 9), and an actuated position (FIG. 10). This first range of travel of PR gear 90 in the releasing direction functions to shift latch release mechanism 46 from a non-actuated state to an actuated state for causing the release of latch mechanism 44.

Reset mechanism 48 is generally shown to include a backdrive lever 110 mounted via a backdrive lever pivot post 112 for pivotal movement relative to latch housing 40 between a first or "unloaded" position and a second or "loaded" position, and a spring-biasing device or backdrive lever spring 114 acting to bias backdrive lever 110 toward its unloaded position. Backdrive lever 110 is configured to include a cam follower edge segment 116 engaging and acting upon raised cam segment 106 on PR gear 90 during rotation of PR gear 90 between its rest and actuated positions. As will be detailed, reset mechanism 48 is operable in a first over-center state and a second over-center state to cause loading and release of backdrive lever spring 114.

Figure 2:
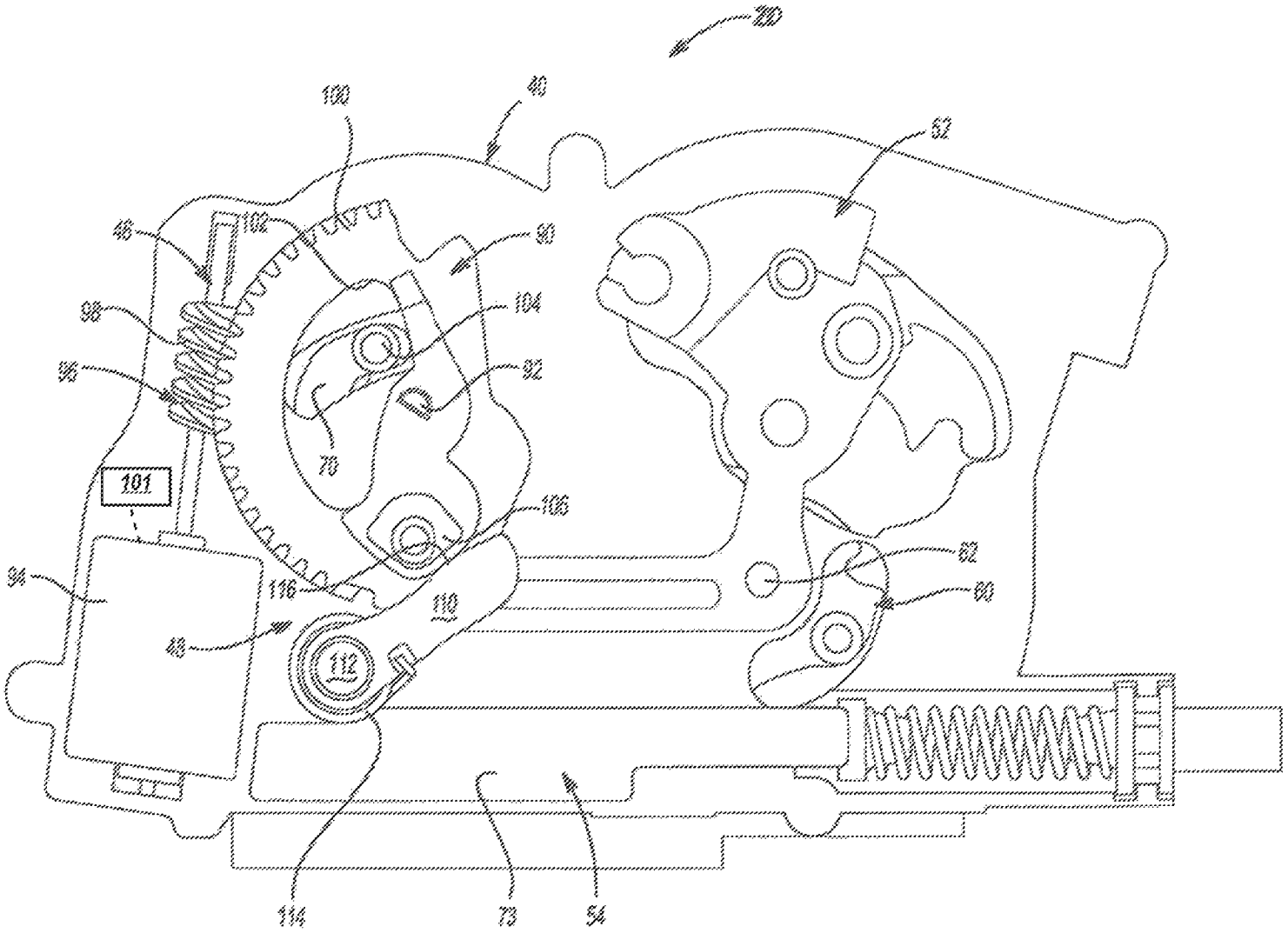
FIG. 2 is a plan view of the closure latch assembly constructed to embody the teachings of the present disclosure and which is equipped with a latch mechanism, a power-operated latch release mechanism, a manually-operated backup latch release mechanism, and a reset mechanism.
Figure 3:
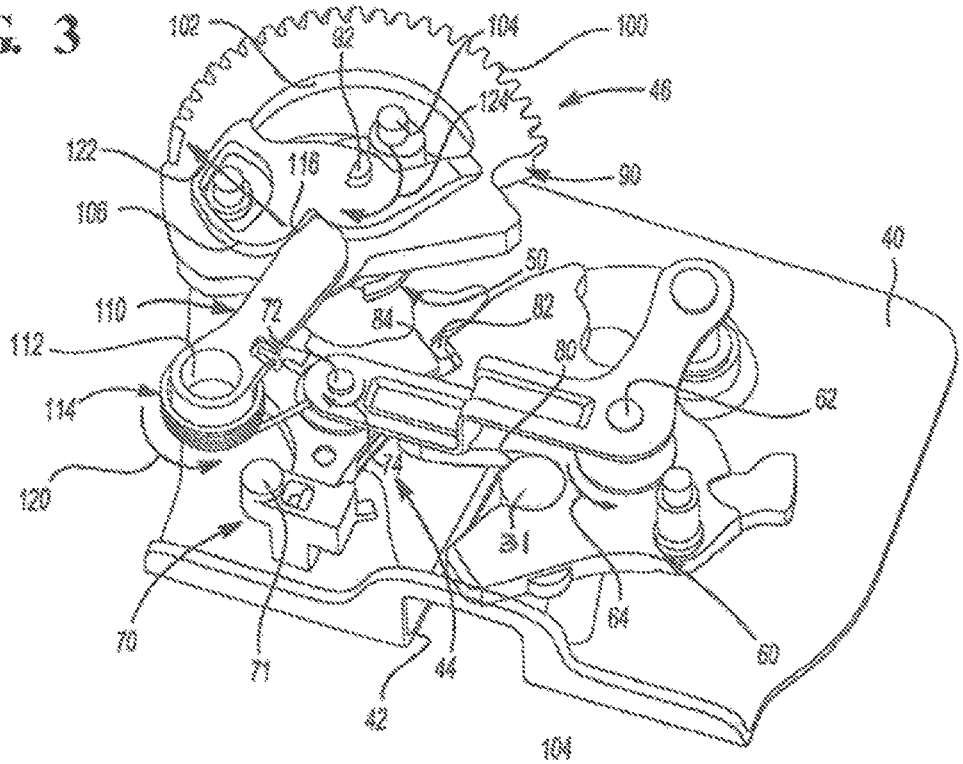
FIG. 3 is an isometric view of the closure latch assembly shown in FIG. 2 illustrating the interaction of the components with the latch mechanism operating in a latched state, the latch release mechanism operating in a non-actuated state with a power release gear located in a "rest" position, and the reset mechanism operating in a first over-center state.

With initial reference to FIG. 3, closure latch assembly 20 is in its latched mode with latch mechanism 44 operating in its latched state such that ratchet 60 is located in its striker capture position, pawl 70 is located in its ratchet holding position, and PR gear 90 is located in its rest position. With PR gear 90 located in its rest position, first pawl drive lug 104 is shown disengaged from drive slot 102. FIG. 3 also shows reset mechanism 48 in its first or "resetting" over-center state. Specifically, backdrive lever 110 is located in its unloaded position. Arrow 120 illustrates the biasing direction applied by backdrive spring 114 on backdrive lever 110 in its unloaded position which, in turn, exerts a reaction force (identified by and directed along arrow 122) against cam segment 106 of PR gear 90. Reaction force 122 is configured to apply a backdrive torque (arrow 124) to PR gear 90 in a second or "resetting" direction (clockwise in FIGS. 2-10).

Figure 4:
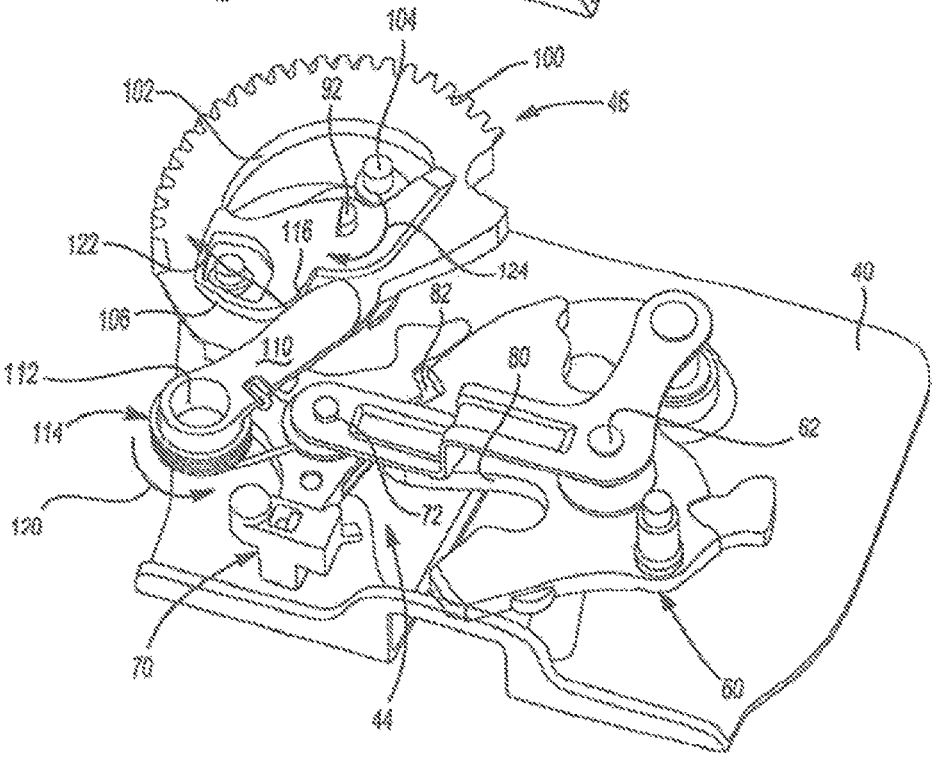
FIG. 4 is similar to FIG. 3 and illustrates the interaction of the components following rotation of the power release gear in a releasing direction from its rest position into an "end of pretravel" position upon initiation of the power release operation.

When it is desired to shift latch mechanism 44 from its latched state into its released state, electric motor 94 is energized, for example in response to an electrical signal provided by a latch controller to the electrical motor 94 over electrical signal lines, to initiate rotation of PR gear 90 in the releasing direction from its rest position toward its pawl engage position (FIG. 4). As is understood, actuation of a sensor or release switch (via operation of a key fob or a handle-mounted push button) signals the latch controller to initiate actuation of electric motor 94. This first amount of rotation of the PR gear 90, identified in this non-limiting example to be about 21°, causes first pawl drive lug 104 to engage the edge profile of drive slot 102 while reaction force 122 (generated by spring 114 acting on backdrive lever 110) continues to generate backdrive torque 124.

Figure 5:
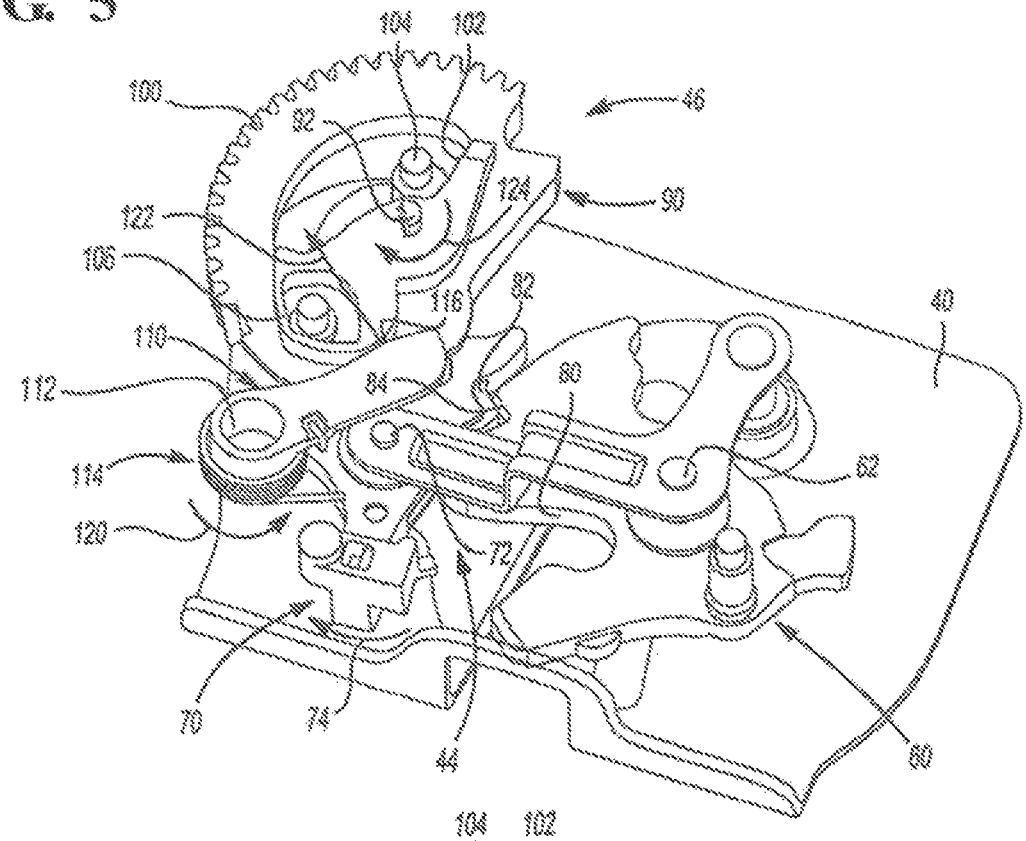
FIGS. 5-8 are likewise similar to FIG. 4 and sequentially illustrate the interaction of the components associated with continued rotation of the power release gear in the releasing direction from its end of pretravel position to a "latch release" position for shifting the latch mechanism into a released state while the reset mechanism is maintained in its first over-center state.
Figure 6:
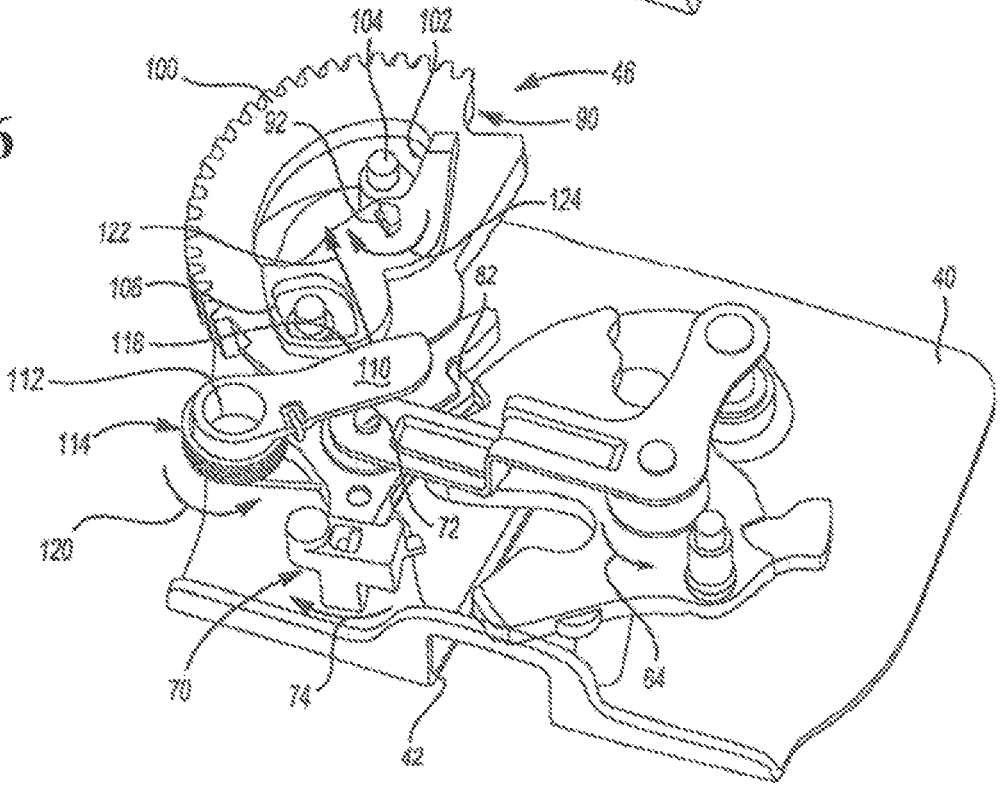
Figure 7:
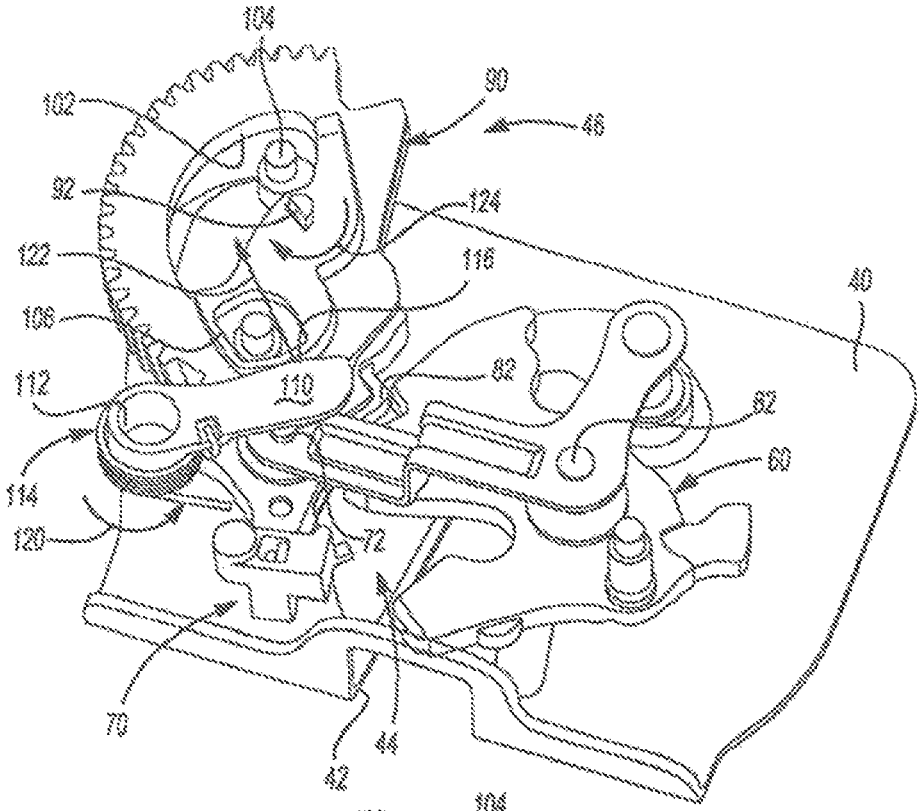

FIGS. 5-7 illustrate that continued rotation of PR gear 90 in the releasing direction causes drive slot 102 to act on first pawl drive lug 104 which, in turn, functions to cause pawl 70 to begin to move from its ratchet holding position toward its ratchet releasing position while pawl engagement lug 82 remains engaged with primary locking notch 84 on ratchet 60. Additionally, cam follower edge segment 116 on backdrive lever 110 continues to maintain engagement with cam segment 106 on PR gear 90. However, the interaction therebetween results in vectorial movement of the force line associated with reaction force 122 relative to the rotary axis of PR gear 90 while still continuing to generate backdrive torque 124.

Figure 8:
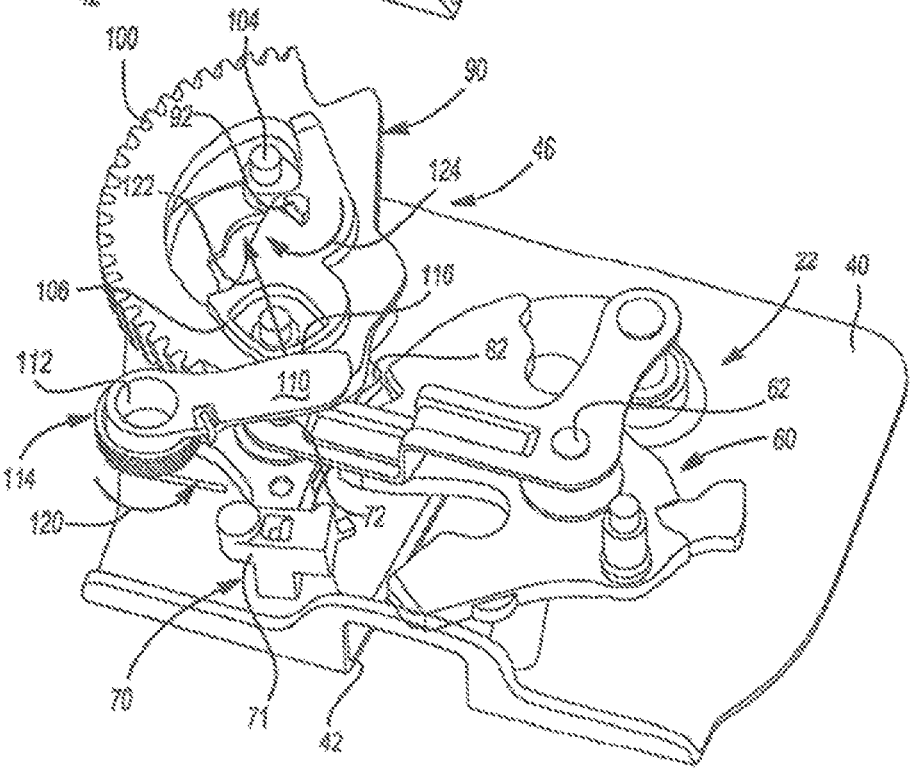

FIG. 8 illustrates continued rotation of PR gear 90 in the releasing direction into its pawl release position whereat pawl 70 has been moved to a position disengaged from ratchet 60 so as to shift latch mechanism 44 into its released state. As such, ratchet biasing member 64, in conjunction or not in conjunction with seal loads generated by the compression of seal 11 acting between the vehicle body 12 and vehicle passenger door 14, forcibly rotates ratchet 60 to its striker release position and establishes the unlatched mode for closure latch assembly 20. This pawl release position has occurred, in this non-limiting example, after about 77° of rotation of PR gear 90 from its rest position such that pawl engagement lug 82 is no longer in engagement with primary locking notch 84 on ratchet 60. With PR gear 90 in position, the line of force associated with reaction force 122 (generated by engagement of backdrive lever 110 with cam segment 106) continues to establish the first over-center relationship between reaction force 122 and the rotary axis of PR gear 90 while still generating backdrive torque 124. Thus, reset mechanism 48 is located to function in a resetting state.

Figure 9:
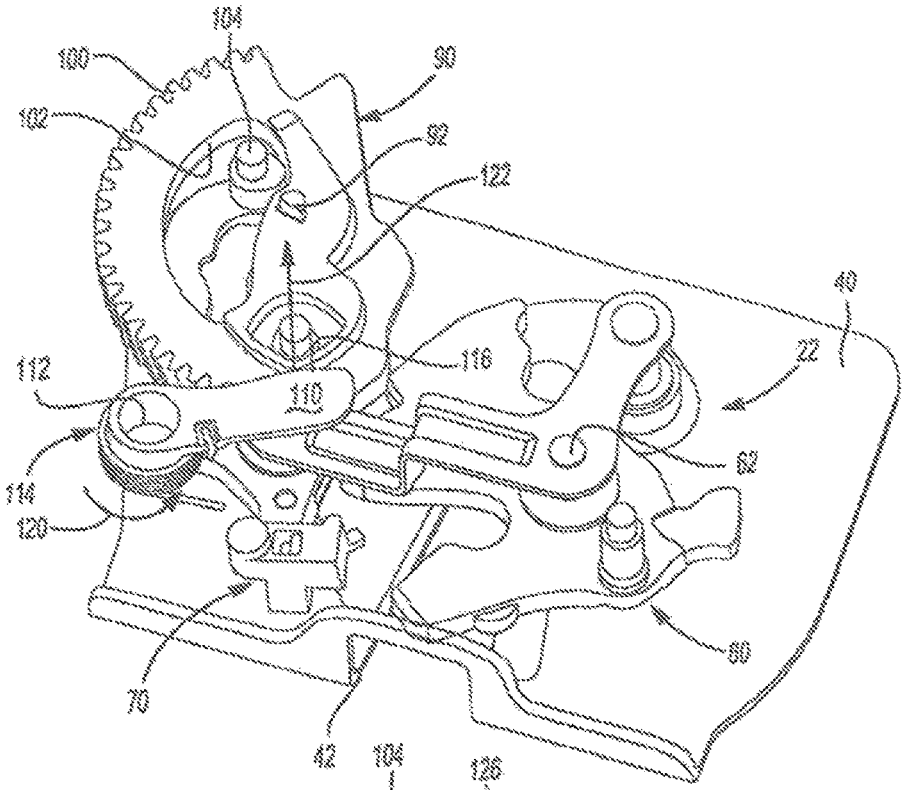
FIGS. 9 and 10 show the interaction and movement of the components of the latch assembly upon continued rotation of the power release gear in the releasing direction from its latch released position into an "actuated" position and which causes the reset mechanism to shift from its first over-center state into a second over-center state.
Figure 10:
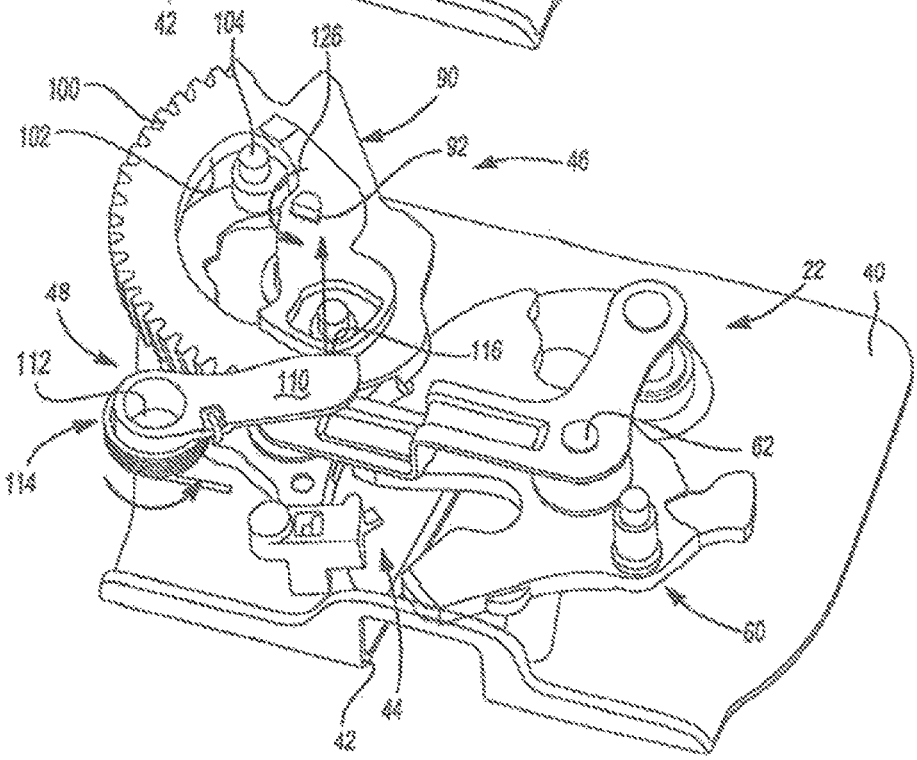

FIG. 9 illustrates that slightly more rotation of PR gear 90 in the releasing direction results in the line of force associated with reaction force 122 (generated by engagement of backdrive lever 110 with cam segment 106) establishes an on-center relationship with respect to the rotary axis, whereby no backdrive torque is generated and applied by reset mechanism 48 to PR gear 90. In this position, the ratchet 60 has already been released from the pawl 70 and been allowed to rotate to the release position, although as illustrate the ratchet 60 has not moved. It will be appreciated that the bias on the ratchet 60 will have rotated the ratchet relative to the position shown in FIG. 9.

FIG. 10 illustrates continued rotation of PR gear 90 in the releasing direction into its actuated position whereat pawl 70 is mechanically held by PR gear 90 in its ratchet releasing position. In this non-limiting example, rotation of about 100° is required to rotate PR gear 90 from its rest position to its actuated position. Here, backdrive lever 110 is located in its loaded position such that the line of force associated with reaction force 122 has established the second or "holding" over-center state with respect to the rotary axis of PR gear 90, whereby a negative (counterclockwise) backdrive torque is generated, as identified by arrow 126. Thus, reset mechanism 48 now defines a holding state. In this position, motor 94 can be turned off and the interaction between backdrive lever 110 and cam segment 106 is solely responsible for mechanically holding PR gear 90 in its actuated position which, in turn, continues to hold pawl 70 in its ratchet releasing position. Similar to FIG. 9, in this position, the ratchet 60 will have rotated to its release position.

To subsequently return reset mechanism 48 to its resetting state, once a signal has been received by the latch controller 101 indicating that door 14 has moved to its open position, motor 94 is actuated to rotate gearset 96 in a second direction so as to cause rotation of PR gear 90 in the second or "resetting" direction about its rotary axis (clockwise) through a second range of rotary motion required to rotate PR gear 90 from its actuated position (FIG. 10) to its pawl release position (FIG. 8). This limited rotation (about 23°) of PR gear 90 in the resetting direction via actuation of motor 94 results in backdrive lever 110 moving from its second over-center position (FIG. 10) through its on-center position (FIG. 9) into its first over-center position (FIG. 8). With backdriver lever 110 positioned in its first over-center position (FIG. 8), the reaction force 122 applied by backdrive lever 110 on cam segment 106 (due to the biasing exerted by spring 114) forcibly drives PR gear 90 in the resetting direction from its pawl release position (FIG. 8) back to its rest position (FIG. 3).

Such rotation of PR gear 90 back to its rest position also permits rotation of pawl 70 (due to the clockwise bias on the pawl 70) back toward its ratchet holding position in preparation for striker 31 subsequently engaging and rotating ratchet 60 from its striker release position into its striker capture position whereat pawl 70 can move its engagement lug 82 back into latched engagement with primary locking notch 84 on ratchet 60. Put another way, with the pawl 70 having rotated back to its ratchet holding position, when the ratchet 60 is impacted by the striker 31, the striker will rotate the ratchet 60 clockwise, and the locking notch 84 of the ratchet 60 will slide past the engagement lug 82. After passing the engagement lug 82, the bias on the pawl 70 will move the engagement lug 82 back into position to block the ratchet 60 from rotating counter-clockwise. The advantage associated with this power-operated resetting operation is that only limited motor actuation is required to drive PR gear 90 from its actuated position to its pawl release position, in conjunction with the subsequent mechanical rotation of PR gear 90 to its rest position via spring-loaded backdrive lever 110. In addition, this arrangement reduces associated motor noise and assists in resetting closure latch assembly 20 in event of a power failure during the resetting operation.

While not specifically shown in detail, power cinch mechanism 52 is operable to rotate ratchet 60 to its fully cinched primary striker capture position from a secondary striker capture position. Power cinch mechanism 52 may include a power cinch actuator and cinch linkage converting the output of the cinch actuator into rotation of ratchet 60 in the latching direction. Likewise, while not specifically shown in FIG. 2, IS latch release mechanism 54 is operable to rotate pawl 70 from its ratchet holding position to its ratchet releasing position in response to selective actuation of an inside handle-operated actuation rod 73 associated with IS latch release mechanism 54 to unlatch/release latch mechanism 44. A second drive lug portion 71 (FIG. 3) on pawl 70 is coupled to actuation rod 73. Bowden cable 22 (FIG. 1) has one end connected to inside handle 24 and its opposite end connected to actuation rod 73. Actuation rod 73 is biased by a return spring 75 to a non-actuated position (FIG. 2) and is moved to an actuated position in response to a pull on handle 16. This movement of actuation rod 73 (to the right in FIG. 2) results in its engagement with second pawl drive lug 71 for causing movement of pawl 70 from its ratchet holding position to its ratchet releasing position.

Thus, the pawl 70 may be rotated counter-clockwise to release the latch mechanism 44 in at least two different ways: in response to rotation of the PR gear 90, which impacts lug 104 of the pawl and rotates the pawl 70; or in response to translation of the rod 73, which impacts lug 71 and rotates the pawl 70. In the case of the rod 73 translating to impact and rotate the pawl 70, the PR gear 90 may not rotate, and the reset mechanism does not move. When the rod 73 is de-actuated and biased back to the left in FIG. 2 by influence of return spring 75, the bias on the pawl 70 will rotate the pawl 70 clockwise and back to its ratchet holding position, and in a position to later hold the ratchet 60 in place after the ratchet has been impacted by the striker 31 and rotated back clockwise and into engagement with the pawl 70. Accordingly, both an electrical release of the ratchet 60 or a manual release of the ratchet may be achieved.

Referring now to FIGS. 11 through 16G, a second non-limiting embodiment of a closure latch assembly 20A will now be described. In general, closure latch assembly 20A is a modified version of closure latch assembly 20 disclosed and described above with reference to FIGS. 2-10. Accordingly, common reference numerals are used to identify common components with the understanding that the previous disclosure related to function and/or structure thereof is again applicable in conjunction with closure latch assembly 20A. In general, as described above, closure latch assembly 20 is equipped with a dedicated mechanical backup latch release mechanism 54 having a kinematic chain that is distinct and uncoupled from operation of the power release function. In contrast, closure latch assembly 20A is configured to employ a common kinematic chain to control actuation of power-operated latch release mechanism 46 and backup latch release mechanism 54, as will be described in greater detail in the following disclosure. In the case of latch assembly 20, a latch controller 101 may receive a signal generated by a sensor in, for example, the door handle 24 to indicate that releasing the ratchet 60 is desired. In the case of latch assembly 20A, and as further described below, a sensor may be disposed within the housing 40 that detects movement caused by the door handle 24 indicating a desire to release the ratchet 60. In such a configuration, door handle 24 is not provided with a sensor, or button, or the like detection means, for detecting the handle movement or a latch release request.

Figure 11:
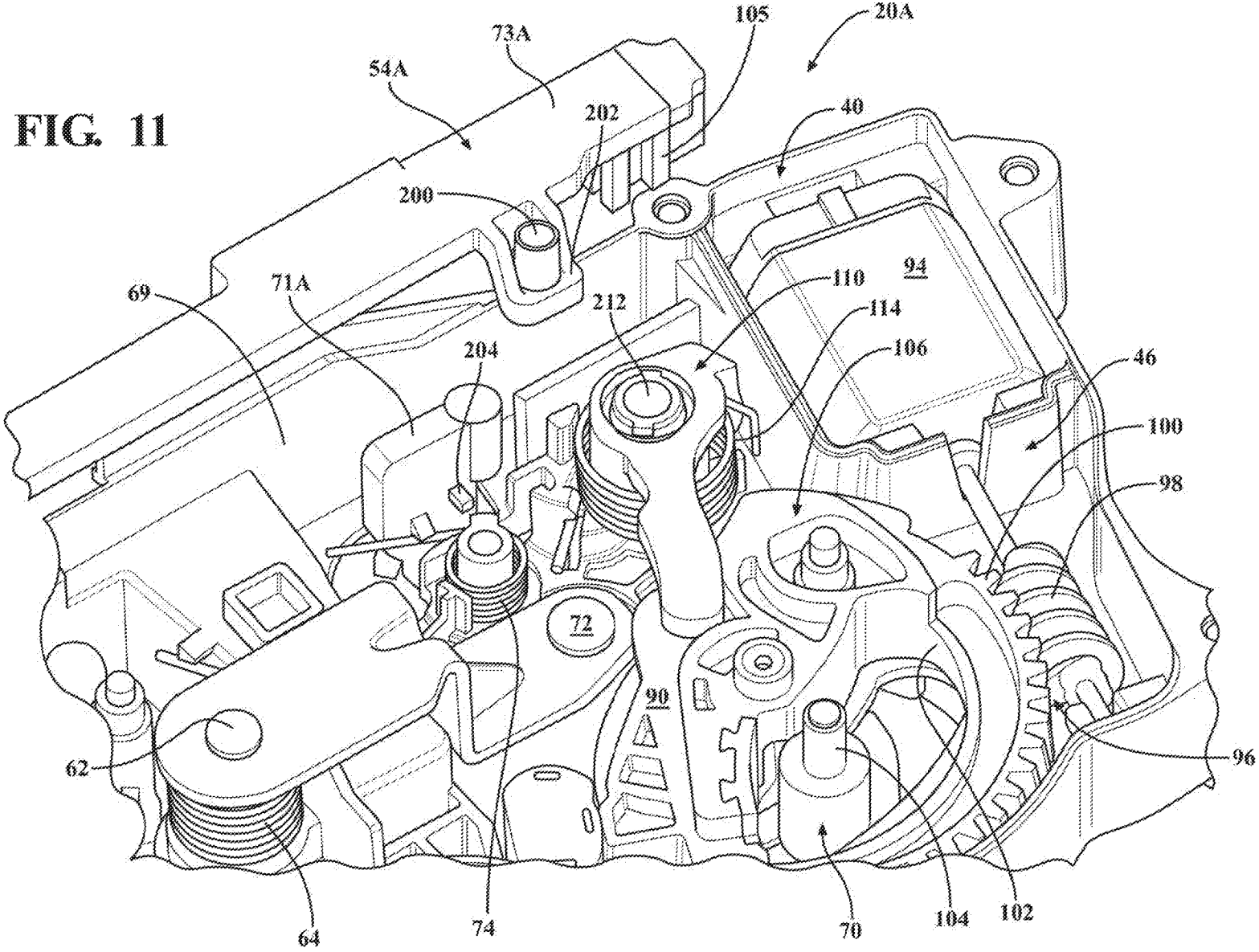
FIGS. 11 and 12 are isometric views of an alternative embodiment for the closure latch assembly of the present disclosure configured to utilize a common kinematic chain for actuation of the power-operated latch release mechanism and the mechanical backup latch release mechanism.
Figure 12:
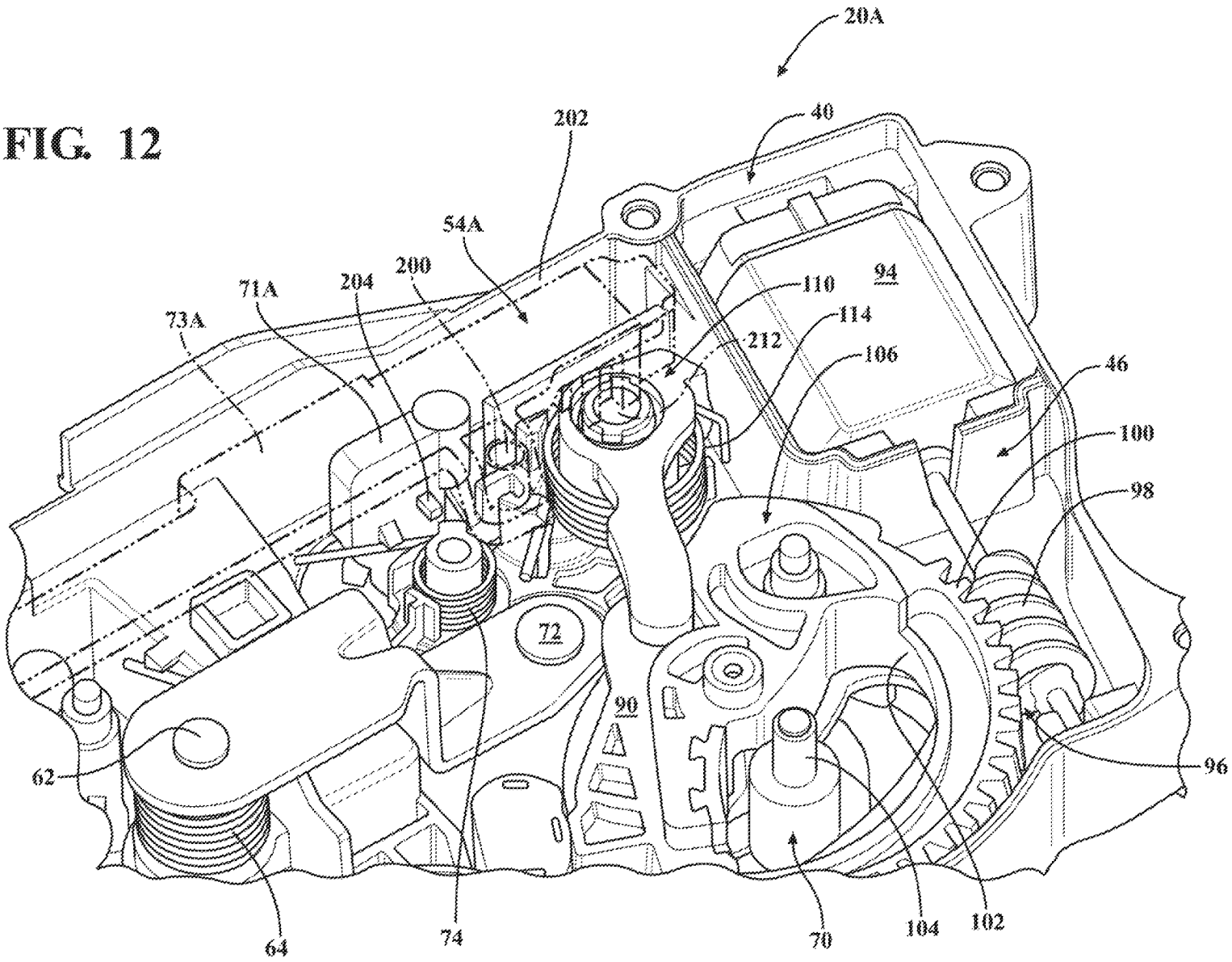
Figure 16:
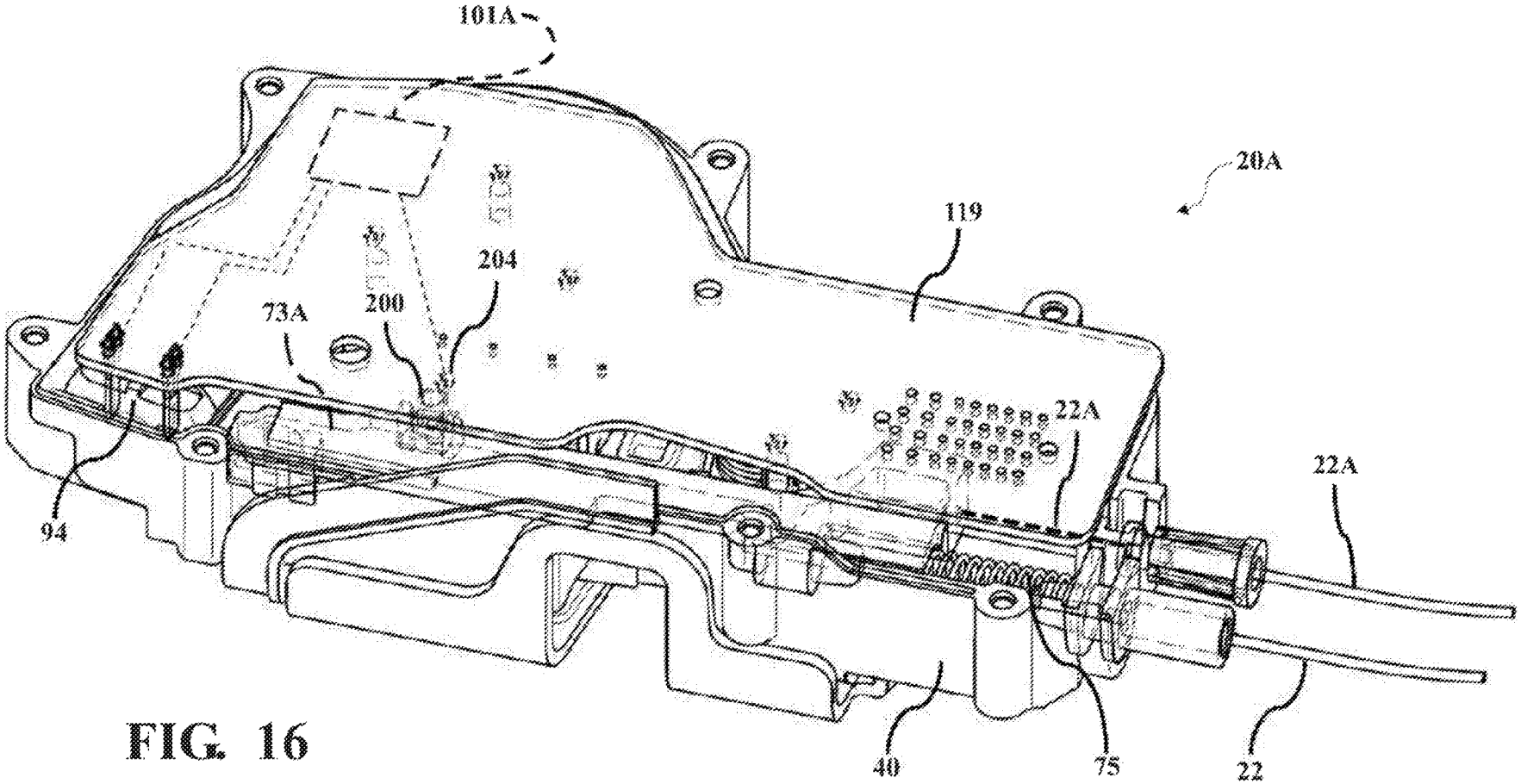
FIG. 16 is an isometric view of an embodiment for the closure latch assembly of the present disclosure illustrating a printed circuit broad supporting a controller and a hall-type release sensor used to trigger actuation of the power-operated latch release mechanism.
Figure 18:
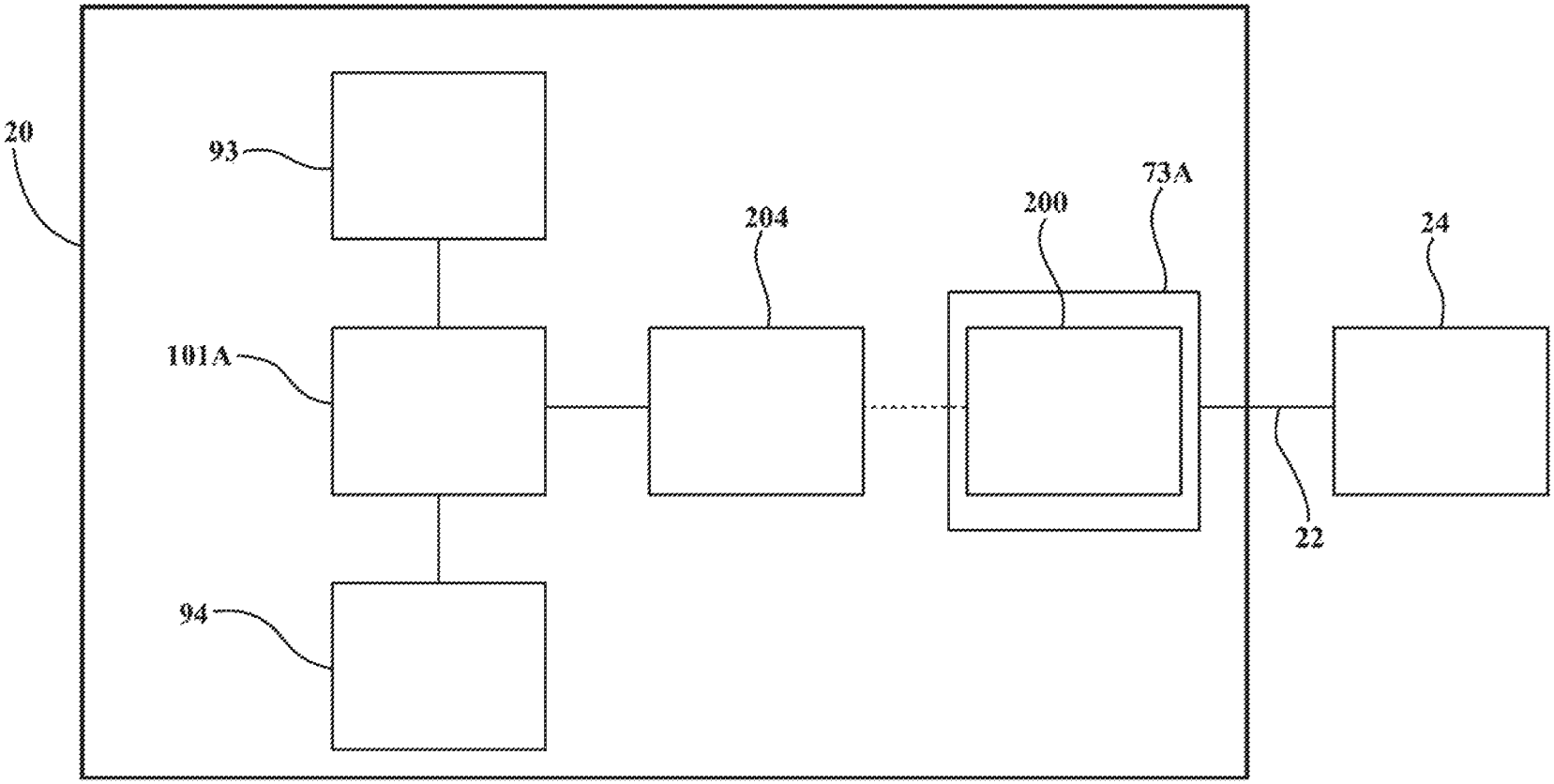
FIG. 18 is a system diagram illustrating the connection of a latch controller with a sensor and a power release motor of the latch assembly of FIG. 11, in accordance with an illustrative embodiment.

With reference to FIG. 11, backup latch release mechanism 54A includes actuation rod 73A, or also generally referred to as an actuation linkage 73A, supported for sliding translational movement relative to latch housing 40. Illustratively, actuation linkage 73A is configured for linear translational movement, however actuation linkage 73A may be configured otherwise, such as embodied as a pivotal lever configured for rotational translational movement. FIG. 11 illustrates the rod 73A being raised out of the housing 40 for illustrating guide channel 69 formed in housing 40 within which rod 73A translates, while FIG. 12 illustrates the rod 73A in place within the guide channel 69 and the housing 40. A magnet 200 is mounted on a lug segment 202 of actuation rod 73A and is configured to move relative to a release switch or sensor 204 that is mounted within closure latch assembly 20A for detecting movement of actuation rod 73A. With reference to FIG. 16 and FIG. 18, release switch or sensor 204, for example a hall sensor, is mounted to printed circuit board (PCB) 119 provided and sealed within housing 40, such that magnet 200 will move relative to the release switch or sensor 204 when rod 73A translates. Hall sensor 204 is provided in electrical communication with the latch controller 101A, also illustratively provided on PCB 119 for example and includes a microprocessor, a memory and other supporting electronics mounted to PCB 119. While a hall sensor and magnet sensor configuration is illustrated, other sensing configurations are contemplated, such as a mechanical switch provided on housing 40 or PCB 119 which is configured to be activated by a movement of rod 73A, for example by switch (not shown) engaging with lug segment 202. The signal provided by release sensor 204 to the latch controller 101A is processed and used by the latch controller 101A to selectively trigger actuation of power-operated latch release mechanism 46, and for example the controller 101A controls actuation of motor 94 in response to receiving and processing the signal provided by release sensor 204. Thus, movement of the rod 73A is detected by the sensor 204, which may signal to the latch controller 101A to actuate the PR gear 90 in a manner similar to that described above regarding latch assembly 20.

Figure 14:
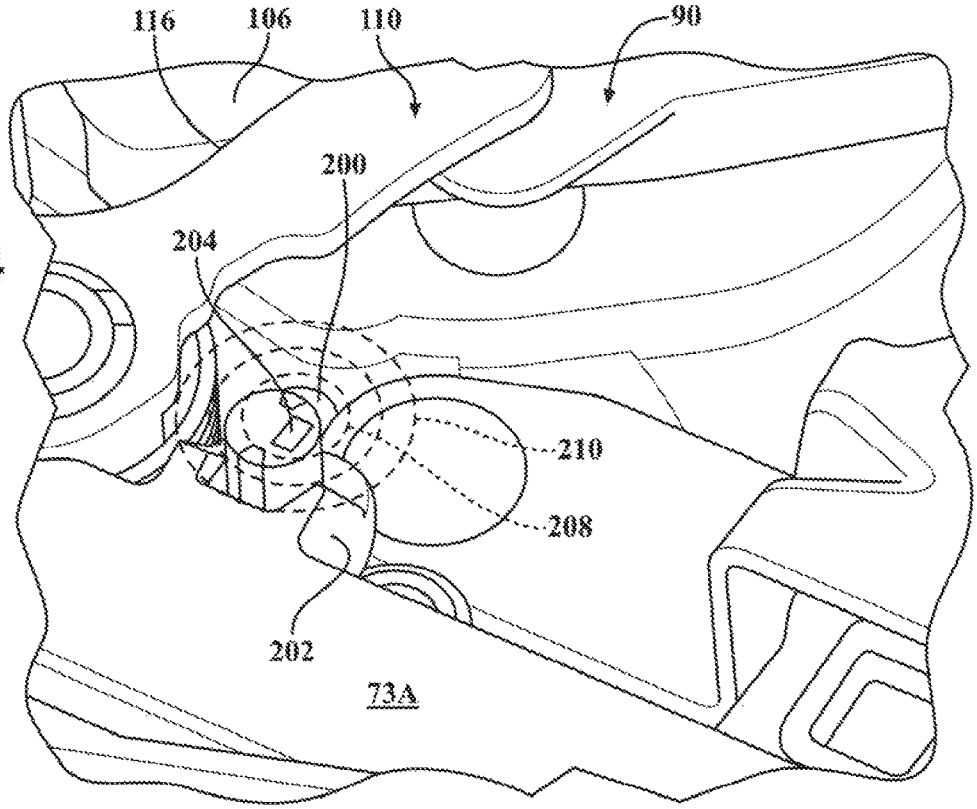
FIG. 14 is a partial isometric view of the closure latch assembly shown in FIGS. 11 and 13 illustrating the location of a Hall-type release sensor used to trigger actuation of the power-operated latch release mechanism.

FIG. 14 generally illustrates this arrangement of the magnet 200 carried on the rod 73A and in position relative to the sensor 204, and also shows a non-limiting "minimum" range tolerance 208 and a "maximum" range tolerance 210 for detection of magnet 200. Sensor 204 is illustrated in FIG. 16 as mounted to the PCB 119, the PCB 119 not being shown in FIG. 14 for purposes of clarity only. Use of a release sensor, preferably a Hall sensor 204, "embedded" within closure latch assembly 20A offers several advantages. Illustratively hall sensor 204 is embedded by mounting on PCB 119 for example, but hall sensor 204 may be provided at other locations within the housing 40 for detecting the magnet 200. First, it eliminates the need for a switch wiring harness between handle 16 and closure latch assembly 20A (no handle-mounted release sensor required). Next, this arrangement improves and assures water tightness since release sensor 204 is located within latch assembly 20A instead of being located in association with handle 16. When the magnet 200 is in range of the sensor 204, the sensor 204 will detect the presence of the magnet 200. When the magnet 200 moves beyond the range of the sensor 204, the sensor 204 will indicate that the rod 73A has been actuated. Thus, actuation of the door handle 24 is detectable by the sensor 204.

Thus, the power release mechanism 46 may be actuated in response to the movement of the rod 73A. For example power release mechanism 46 may be activated in response to the hall sensor 204 moving out of the "maximum" range tolerance 210, in a manner as will be described herein below. In accordance with another example, power release mechanism 46 may be activated in response to the hall sensor 204 moving into the "maximum" range tolerance 210 in a configuration where magnet 200 is positioned offset and out of range relative to Hall sensor 204 during actuation linkage 73A being in its non-actuated position and within range of hall sensor 204 when actuation linkage 73A being within a first minimum actuated position. Providing the magnet 200 positioned within the range of the sensor 204 when the actuation linkage 73A is in its non-actuated position can provide diagnostic information to the controller 101A regarding the state of the handle 17, for example if the handle 17 has not returned to the handle rest position, and for example if pawl 70 has not returned to a ratchet holding position to prevent actuation linkage 73A from returning to its non-actuated position. It will be appreciated that the power release mechanism 46 may also be actuated in other ways, such as a push button or remote signal from a FOB for example, or other signal/control associated with the vehicle 10 that is separate from the door handles 17, 24. As described further below, in the event of a power failure or other failure of the power release mechanism 46 resulting in a loss of electrical power requiring to actuate motor 94, actuation of the rod 73A via the door handle 24 can provide a backup manner of moving the pawl 70 and releasing the latch mechanism 44.

Figure 13:
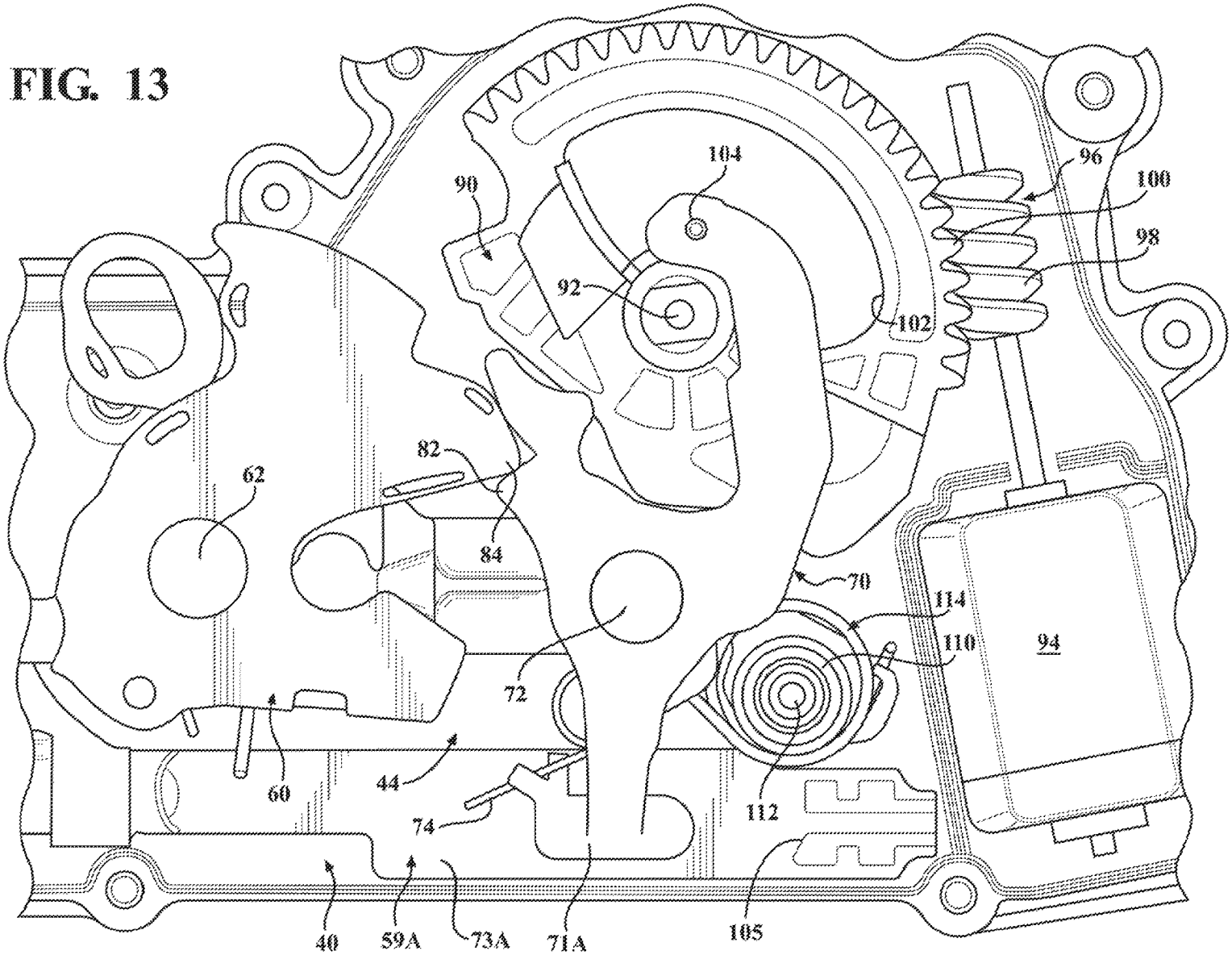
FIG. 13 is a bottom plan view illustrating the latch mechanism associated with the closure latch assembly shown in FIGS. 11 and 12.

Turning now to FIG. 13, a bottom plan view of latch assembly 20A is shown, illustrating various components previously described in relation to the latch assembly 20A or latch assembly 20. The bottom of FIG. 13 illustrates a pawl lug 71A that is part of the pawl 70. Lug 104 is shown near the top of FIG. 13, which is the portion of the pawl 70 that is impacted by the PR gear 90 when the power release mechanism 46 is actuated. In this view, when the PR gear 90 rotates clockwise, the pawl 70 will be rotated clockwise with it, moving locking notch 84 out of engagement with engagement lug 82 of the ratchet 60, as described above.

In FIG. 13, when rod 73A translates to the left, the rod 73A will engage the pawl lug 71A, which will rotate the pawl 70 clockwise to release the ratchet 60. When the rod 73A returns to the right in response to the bias acting thereon, the pawl 70 will rotate counter-clockwise due to its bias, such that the ratchet 60 will be held in place once it has been again positioned in the striker capture position.

The rod 73A may be positioned and configured such that there is some travel distance between the pawl lug 71A and the corresponding structure, illustratively shown as a projecting lug 105 of the rod 73A that impacts the pawl lug 71A. This travel distance is preferably selected such that the movement of the rod 73A may allow the hall sensor 204 to first signal for the power release of the ratchet 60, rather than the mechanical rod-forced release. In other words, the rod 73A may be positioned and configured such that there is first range of travel selected such that the movement of the rod 73A may allow the hall sensor 204 to first signal for the power release of the ratchet 60 without the projecting lug 105 impacting the pawl lug 71A to cause the pawl 70 to mechanically move.

Accordingly, the movement of the pawl 70 caused by the hall sensor 204 being triggered to signal to the latch controller 101A to actuate the motor 94 as part of a power release operation of the latch assembly 20, and the rod-forced movement of the pawl 70 caused by rod 73A engaging pawl 70 as part of a backup mode operation, may be arranged to occur in a sequential fashion, such that the rod-forced movement may only occur if the hall sensor 204 fails to cause the power release mechanism 46 to actuate. Even if the hall sensor 204 causes the actuation, the rod 73A may continue to be actuated, essentially following behind the pawl lug 71A.

Figure 15A:
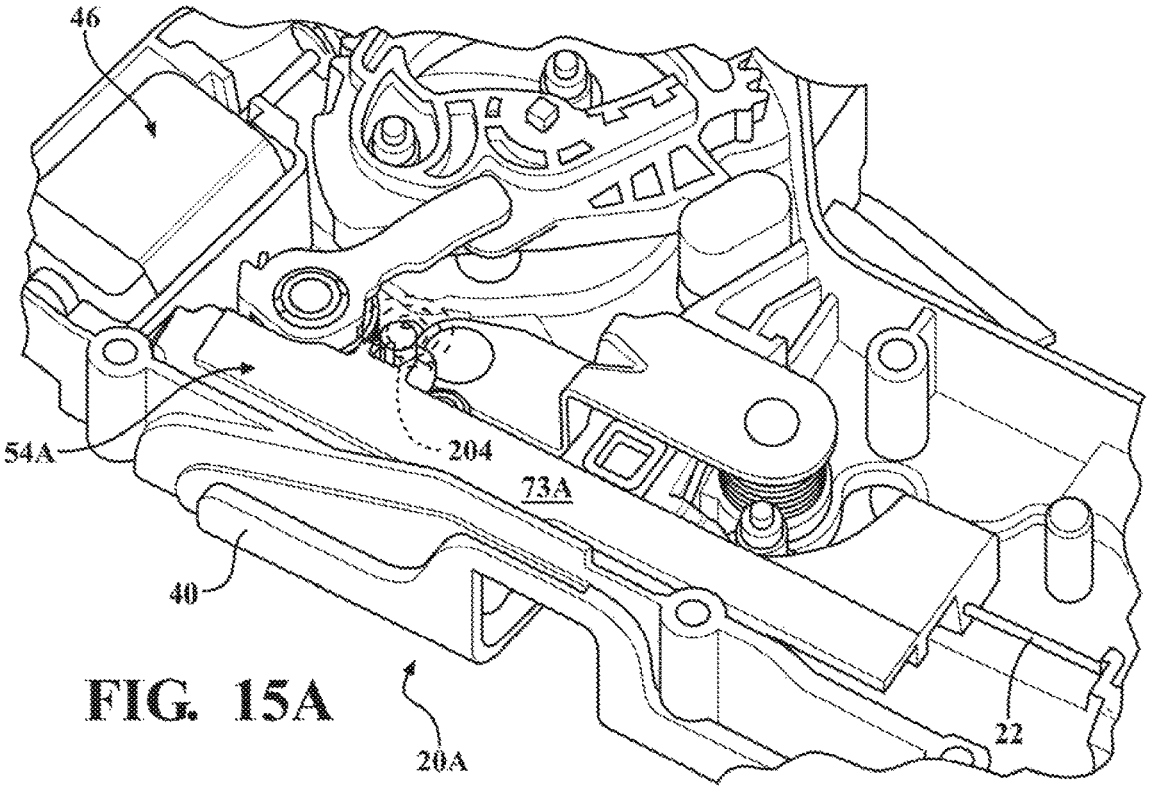
FIGS. 15A through 15G are a series of isometric views showing sequential actuation of the power-operated latch release mechanism and the backup latch release mechanism using the common kinematic actuation chain.
Figure 16A:
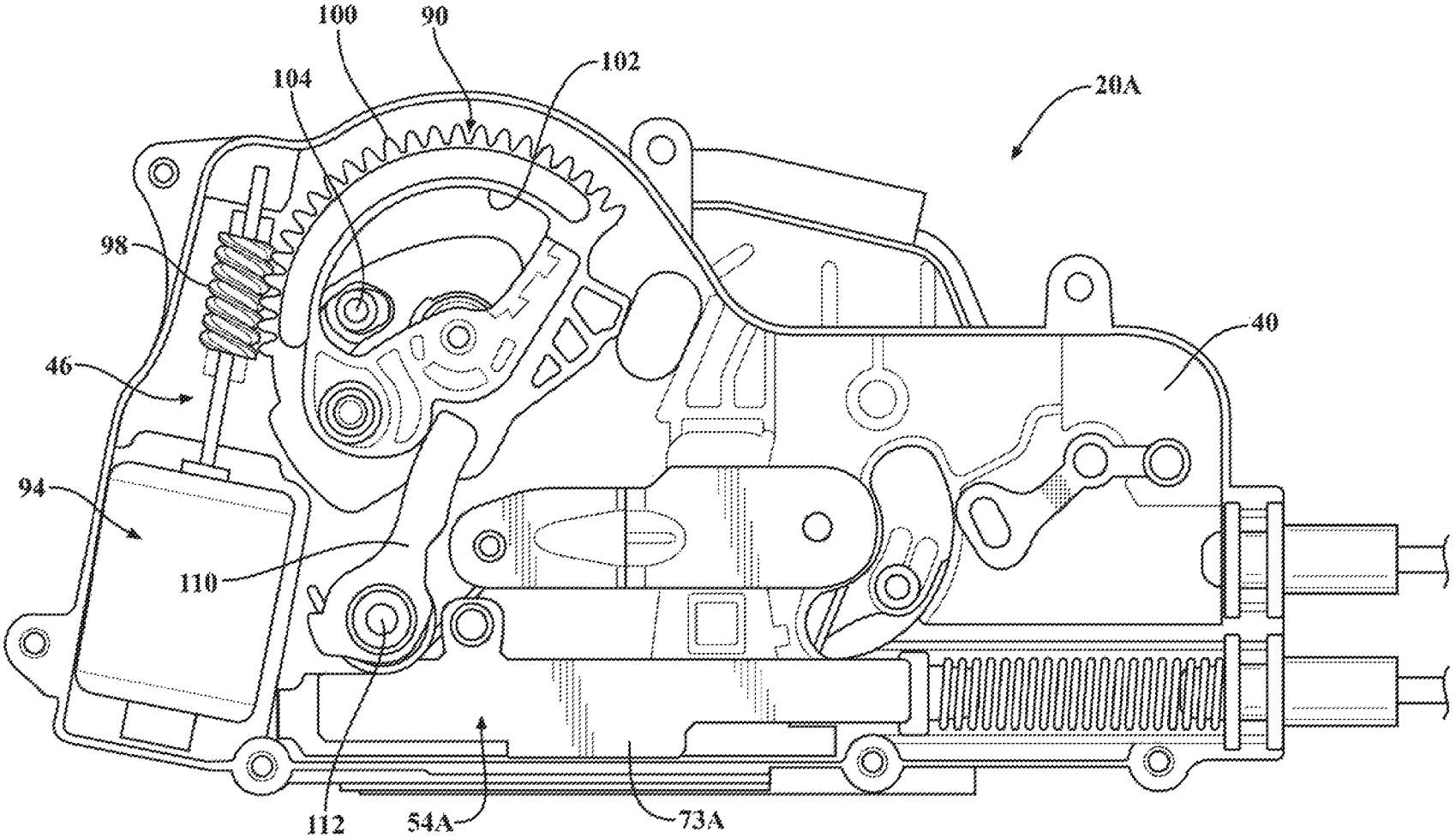
FIGS. 16A through 16G are plan views corresponding respectively to FIGS. 15A-15G to further illustrate the sequential operation of the power-operated latch release mechanism and the backup latch release mechanism.
Figure 19:
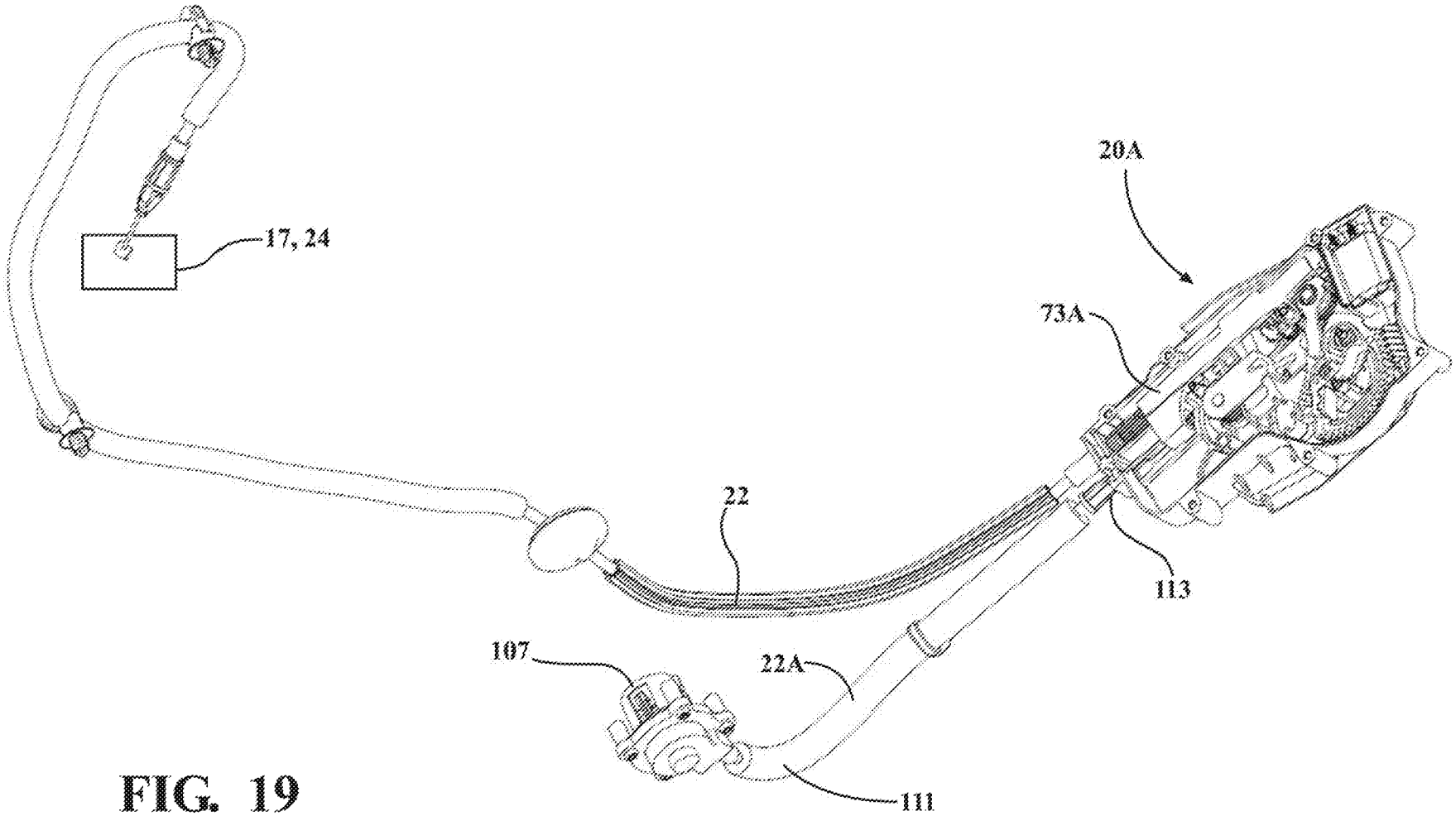
FIG. 19 is a system view illustrating the connections of a handle and a key cylinder with the closure latch assembly of FIG. 11, in accordance with an illustrative embodiment.

Referring initially to FIGS. 15A, 16A, closure latch assembly 20A is shown in an "as delivered" condition prior to connection and tensioning of bowden cable 22 to actuation rod 73A. For reference, Bowden cable 22 is shown attached to the rod 73A in this view, but before the cable 22 pulls the rod 73A to its rest position. In this condition, the magnet 200 is in range of the hall sensor 204, and the power release mechanism 46 will not be actuated by the hall sensor 204. In this condition, the rod 73A may be positioned fully at the end of its biased travel (to the left in these FIGS.). It is recognized that another bowden cable 22A may be provided having one end 111 connected to outside handle 17 and its opposite end 113 connected to actuation rod 73A, as illustrated in FIGS. 1 and 16, such that either actuation of bowden cables 22, 22A by a respective inside handle 24 or outside handle 17 may impart a movement of actuation rod 73A. In accordance with another embodiment and with reference to FIG. 19, bowden cable 22A may be connected to a key cylinder 107 positioned on exterior of door 14, for example integrated with handle 17 adjacent handle 17, such that an activation of the key cylinder 107 by a key (not shown) over a first range of rotation causes a power release operation of the latch assembly 20, and a continued rotation of the key cylinder 107 causes a mechanical backup release operation, in a manner as described herein when actuation rod 73.

Figure 15B:
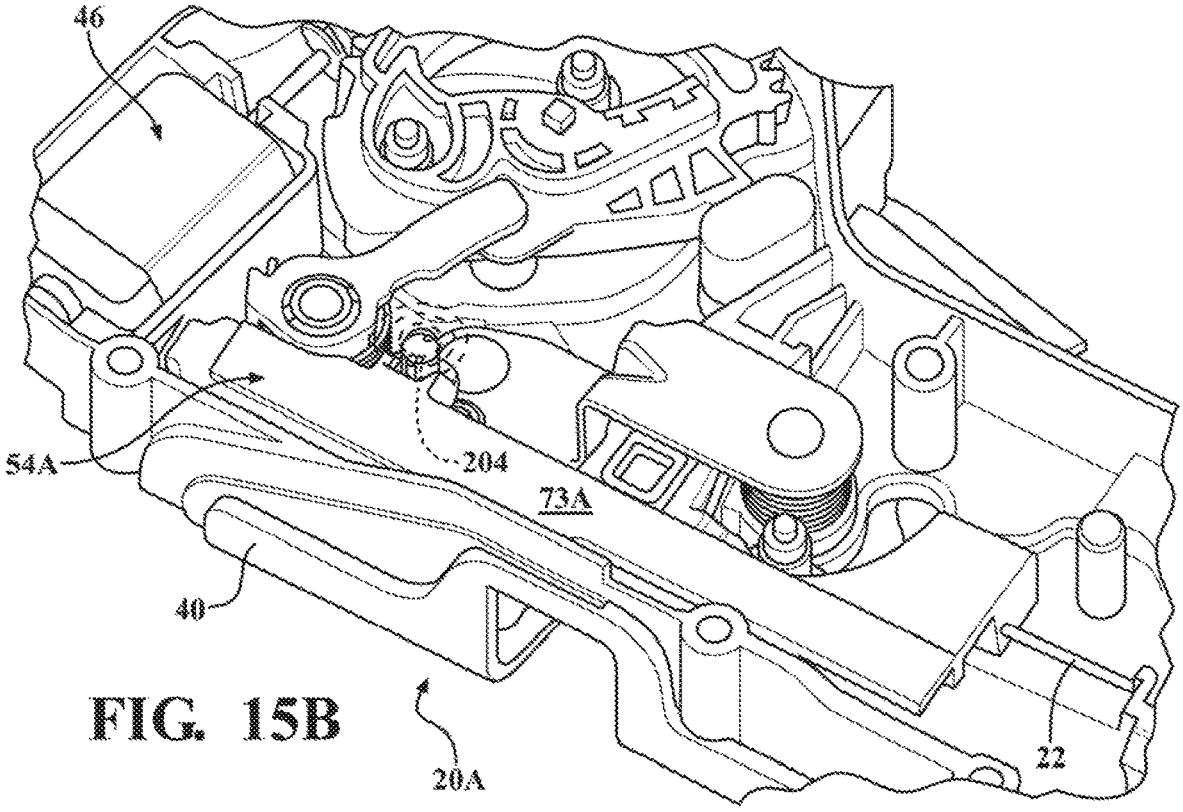
Figure 16B:
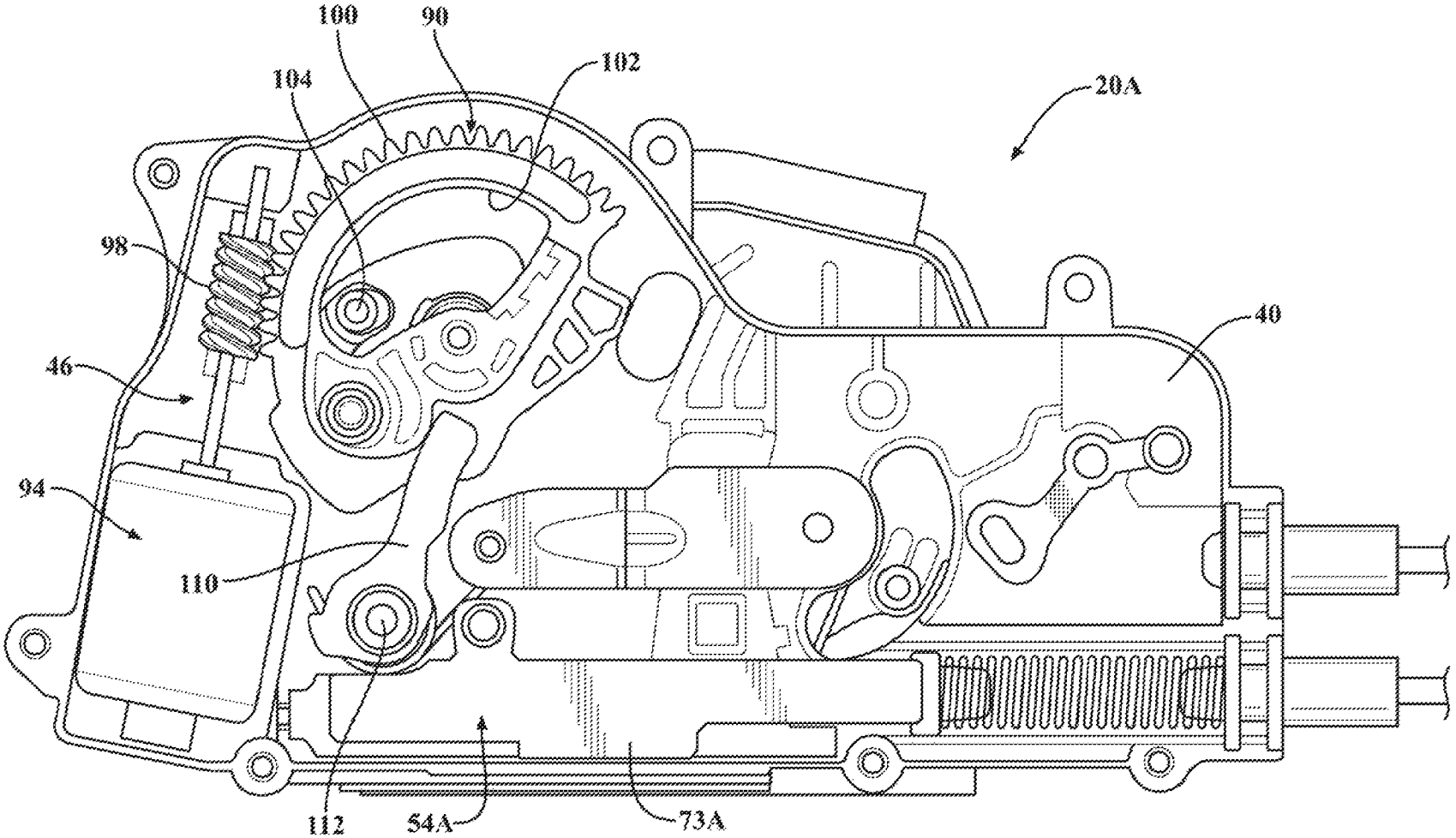

FIGS. 15B, 16B illustrate the location of actuation rod 73A in a "non-actuated" position upon connection to bowden cable 22 and tensioning, when handle 16 is located in a handle rest position and latch mechanism 44 is operating in its latched state, with ratchet 60 held in its striker capture position by pawl 70 being located in its ratchet holding position. Note also that PR gear 90 is located in its rest position. In this condition, the rod 73A may be shifted slightly to the right in the FIGS. relative to the "as delivered" condition due to the Bowden cable 22 being in tension between the rod 73A and the handle 16. In this condition, the magnet 200 may be arranged relative to the hall sensor 204 in a neutral or centered position, and at least within the range of the hall sensor 204. In this "non-actuated" position, the hall sensor 204 accordingly will not signal that the ratchet 60 should be released and will not actuate the power release mechanism 46. In other words, latch controller 101A will not control actuation of motor 94 in response to magnet 200 being within range of the hall sensor 204.

Figure 15C:
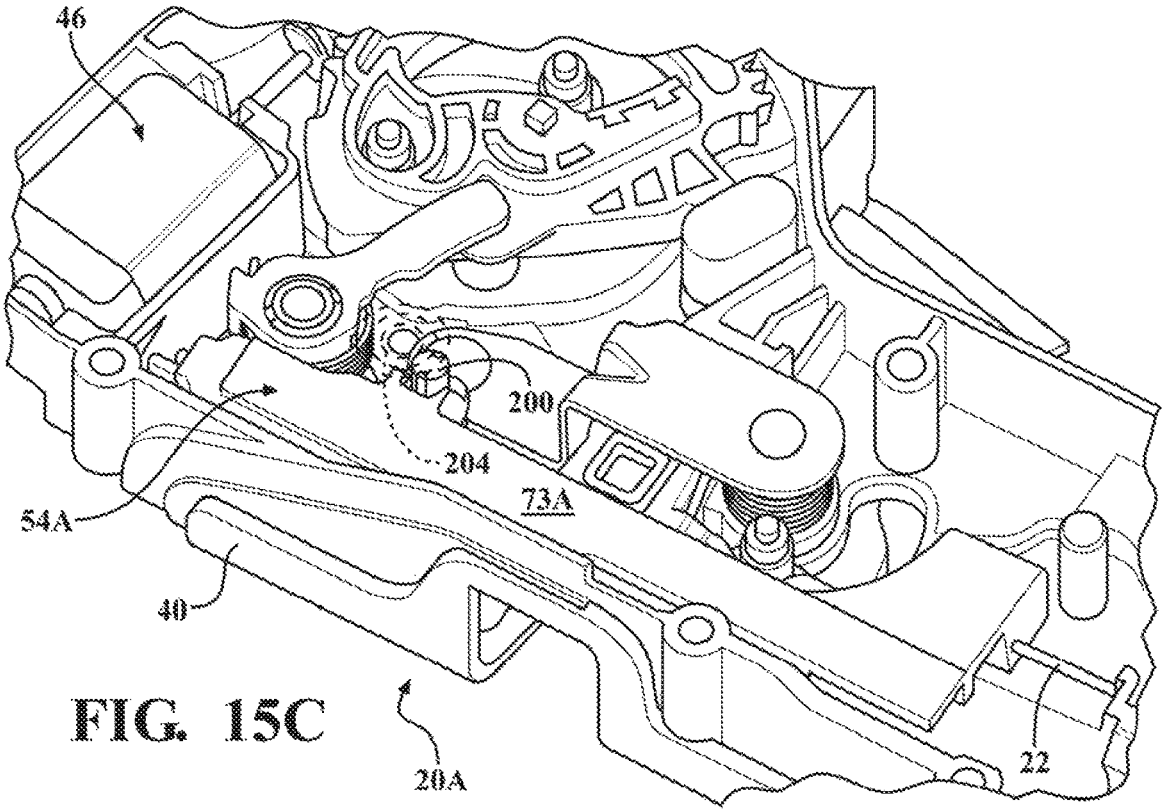
Figure 16C:
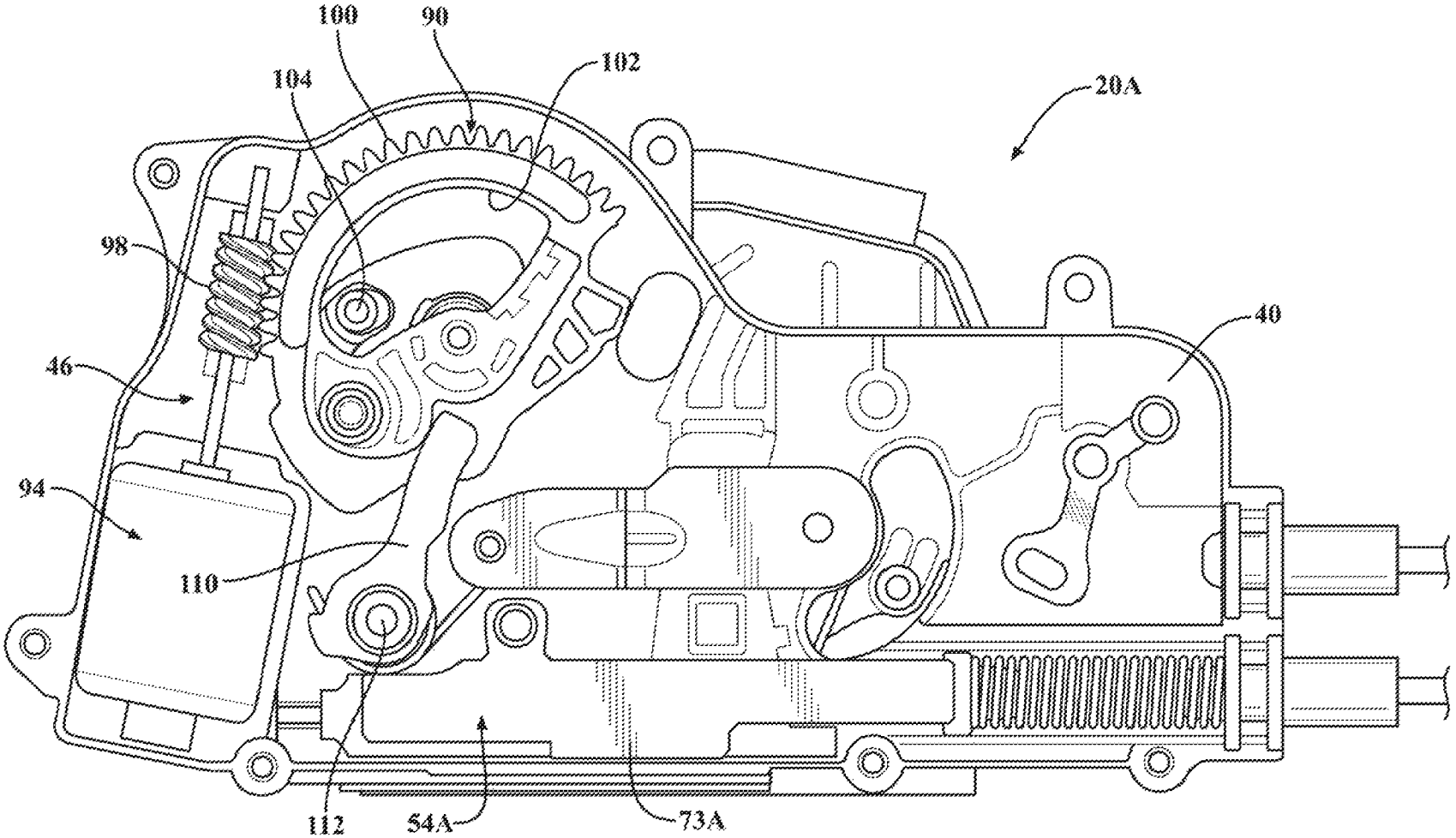

FIGS. 15C, 16C indicate initial sliding movement of actuation rod 73A from its non-actuated position to a first minimum actuated position caused by a first pull movement of handle 16 from its handle rest position into a first handle pulling range. At this position of actuation rod 73A, magnet 200 may be at the minimum tolerance band of the hall sensor 204, and the Hall sensor 204 may then signal the latch controller 101A and latch controller 101A may process the hall sensor 204 signal to actuate electric motor 94 and rotate PR gear 90 from its rest position (FIG. 3) to its actuated position (FIG. 10). Latch controller 101A may be electrically connected to a power supply 93, such as a remote vehicle power supply, or a local power supply such as a supercapacitor, for providing a power supply signal to motor 94. This range of rod travel, defined between its non-actuated and first minimum actuated position, defines a minimum power release activation state. The hall sensor 204 will signal for the activation when the tolerance is at the minimum end of the tolerance range. However, if the range of the hall sensor 204 is greater than minimum, then in this position the hall sensor 204 will not signal for actuation. Rather, the hall sensor 204 will still detect the magnet 200 and the PR gear 90 will remain in its rest position. Put another way, for the hall sensor 204 to signal for actuation, the rod 73A must carry the magnet 200 beyond the range of the sensor 204.

Figure 15D:
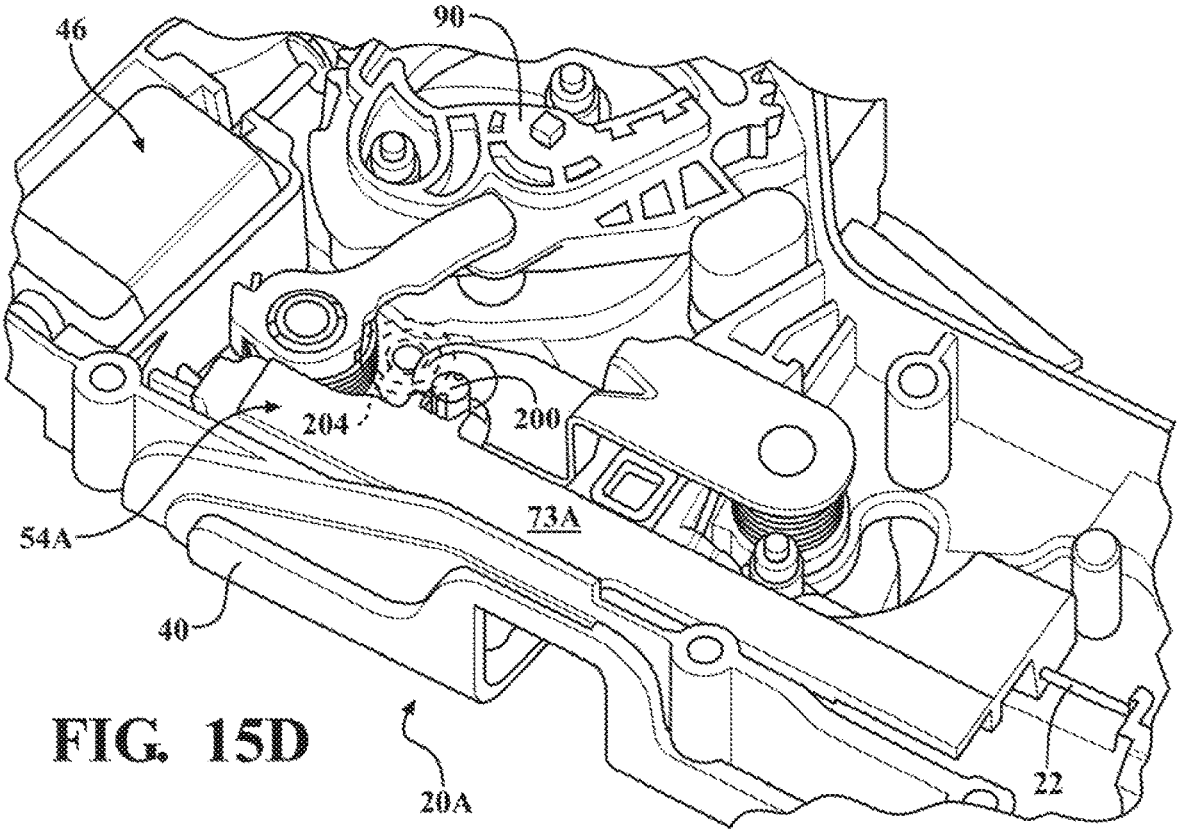
Figure 16D:
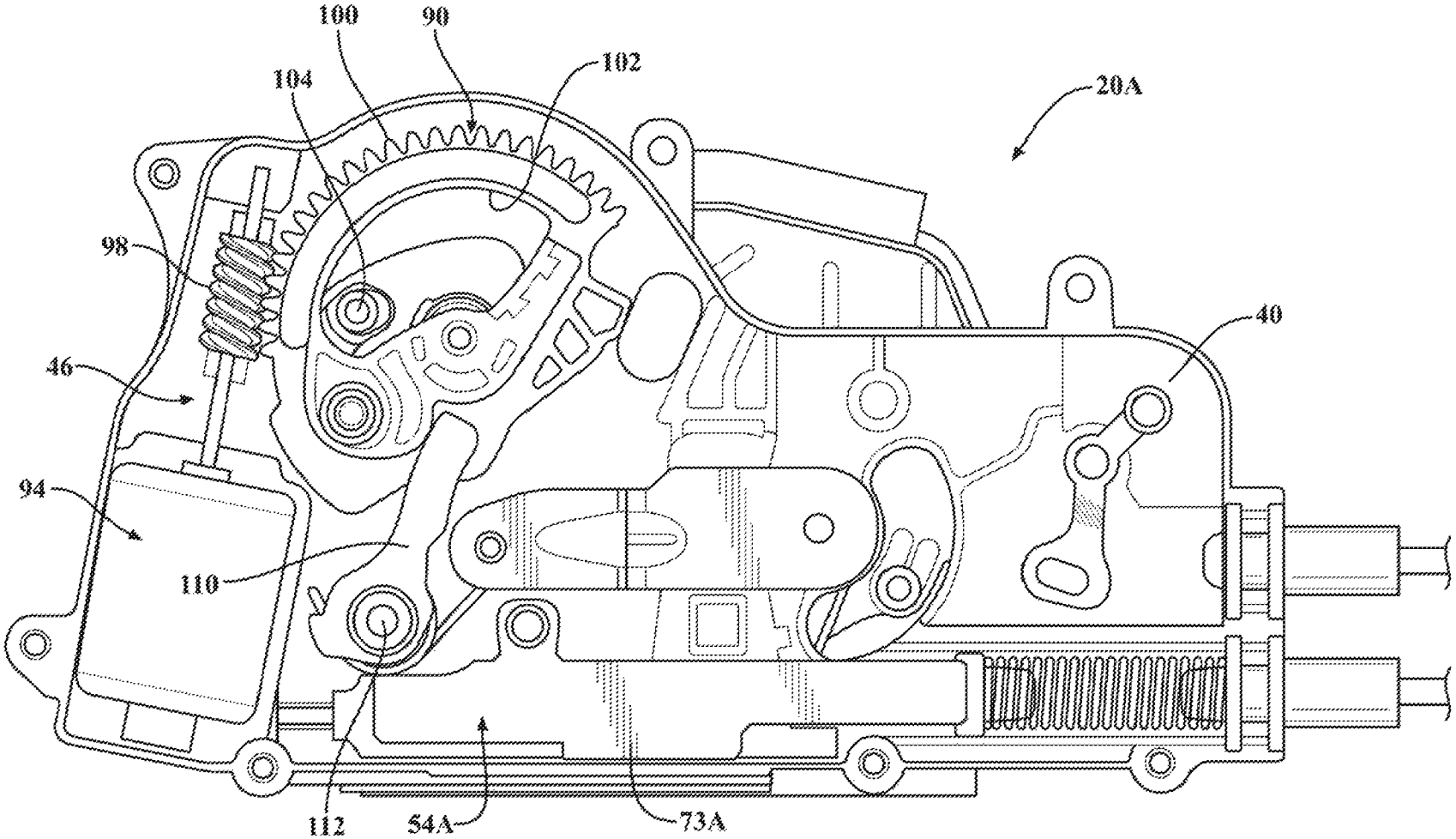

Accordingly, FIGS. 15D, 16D illustrate a maximum power release activation state associated with slightly more travel of actuation rod 73A to a first maximum actuated position caused by movement of handle 16 within its first handle pulling range. In this maximum activation state, the magnet 200 has moved an additional amount relative to the minimum activation state, such that the magnet 200 has reached the maximum range of the tolerance of the hall sensor 204, such that the hall sensor 204 will not detect the magnet 200. Thus, in this position, with the magnet 200 out of range of the hall sensor 204 by reaching the maximum of the tolerance range, the PR gear 90 will be actuated and rotated to the position shown in FIG. 10. Thus, minimum and maximum actuation positions are provided for use with Hall sensor 204 for triggering actuation of power-operated latch release mechanism 46 to provide the power release function. Actual actuation will occur when the magnet 200 is outside of the range of the hall sensor 204

The power release function is provided, as shown sequentially in FIGS. 15A through 15D, via movement of handle 16 from its handle rest position to its first handle release position, which causes concurrent movement of actuation rod 73A from its non-actuated position to its first actuated position. As noted, such movement of actuation rod 73A results in energization of electric motor 94 to drive PR gear 90 from its rest position to its actuated position, whereby first pawl drive lug 104 engages drive slot 102 and forcibly moves pawl 70 to its ratchet releasing position.

In the event that power is lost to closure latch assembly 20A, the use of the common kinematic chain continues to provide a mechanical or "backup" arrangement for moving pawl 70 from its ratchet holding position to its ratchet releasing position to release latch mechanism 44. In particular, continued pulling on handle 16 from its first handle release position to a second handle release position causing continued translational movement of actuation rod 73A from its first actuated position into a second actuated position whereat actuation rod 73A forcibly engages and moves pawl 70 to its ratchet releasing position.

Figure 15E:
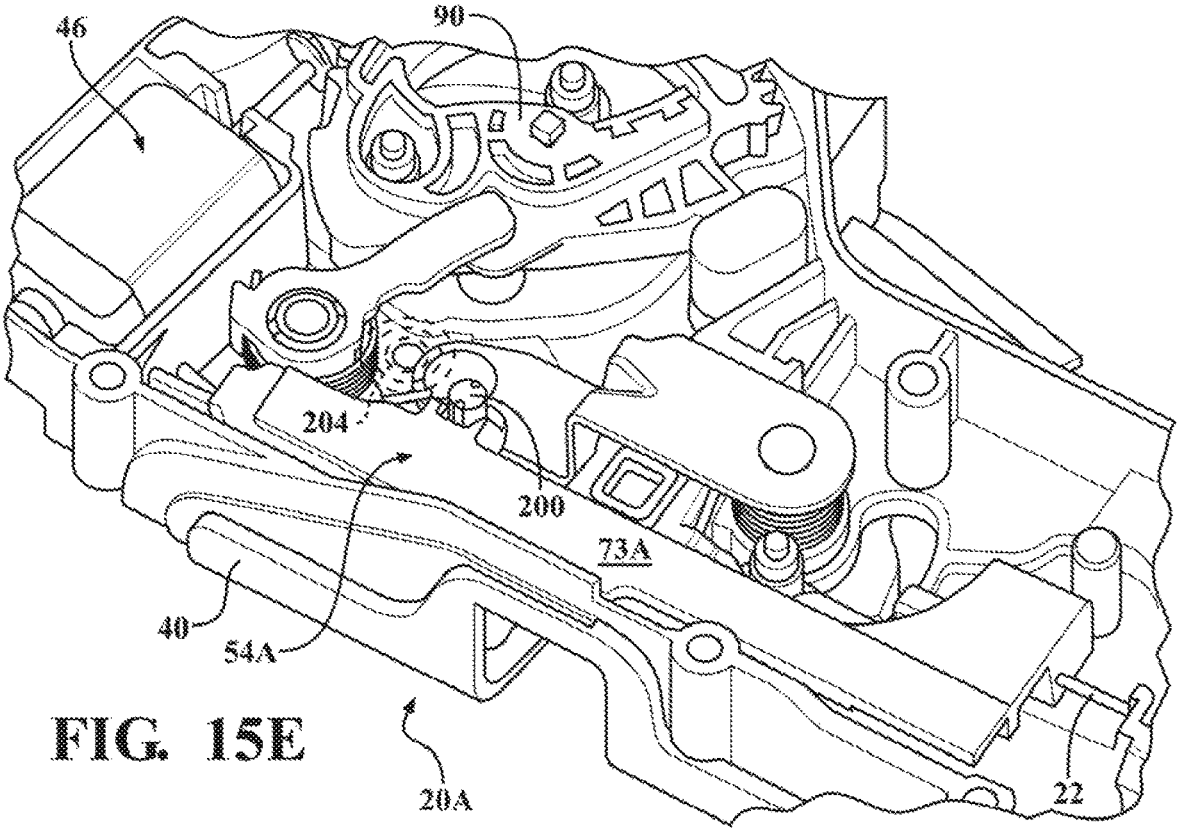
Figure 16E:
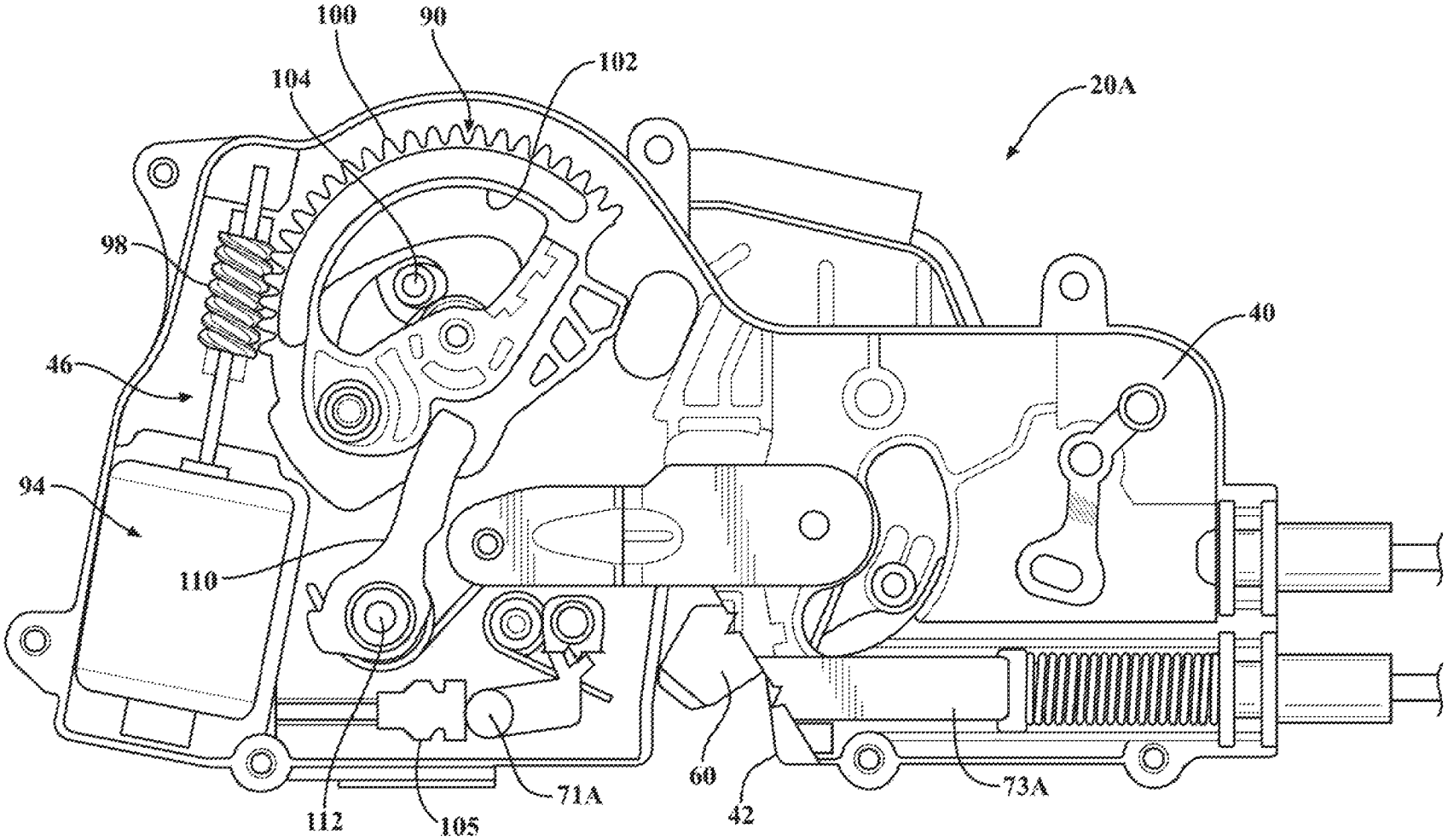

Specifically, FIGS. 15E, 16E indicate that such continued movement of actuation rod 73A causes actuation rod 73A, for example projecting lug 105 of the rod 73A, to initiate engagement with pawl lug 71A. Preferably, the arrangement is provided with a small amount of free travel between the end of the power release activation range of travel (first range of travel-power release) and the beginning of a mechanical release activation range of travel (second range of travel-manual release). As shown in these FIGS., the rod 73A has moved an additional amount relative to the maximum activation state. The magnet 200 is out of range of the hall sensor 204, and therefore if the pawl 70 has not been actuated, then the mechanical backup will engage at this point. If the power release mechanism has been actuated, then at this position of the rod 73A, the pawl 70 may already be rotated to have released the ratchet 60.

Figure 15F:
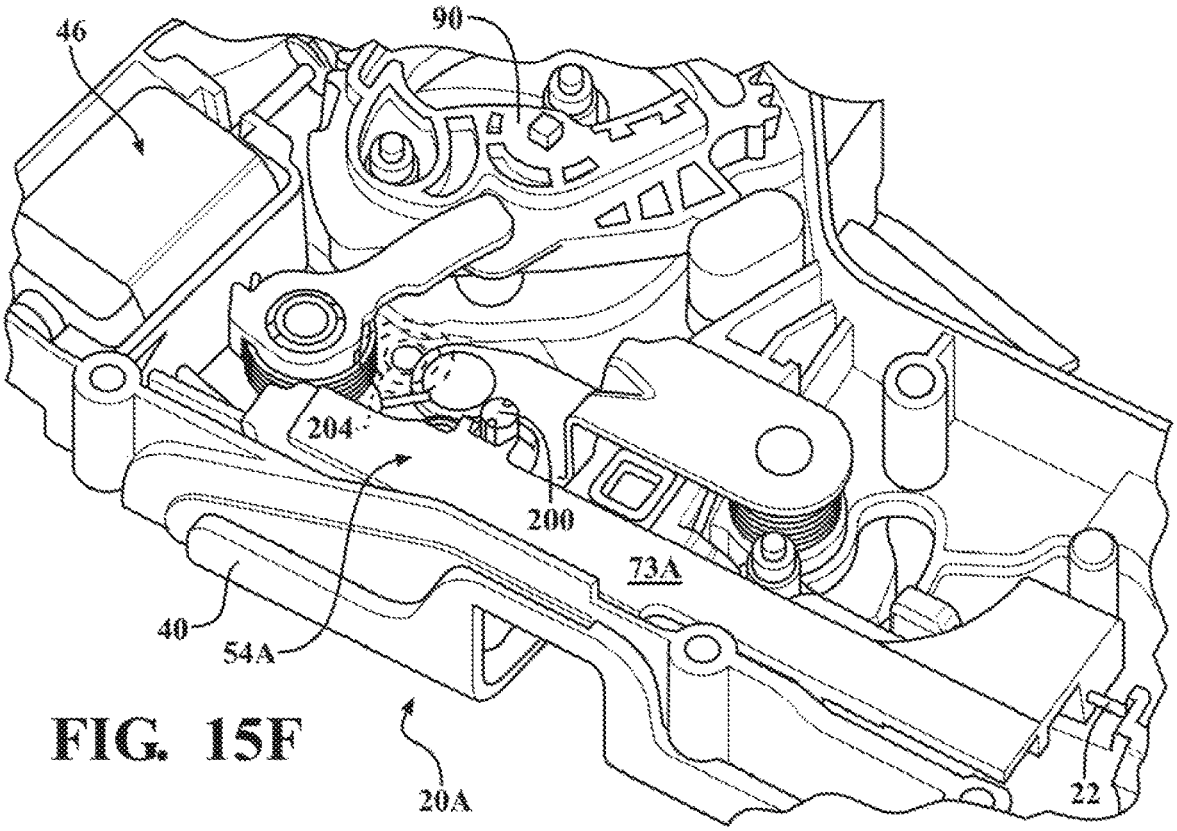
Figure 16F:
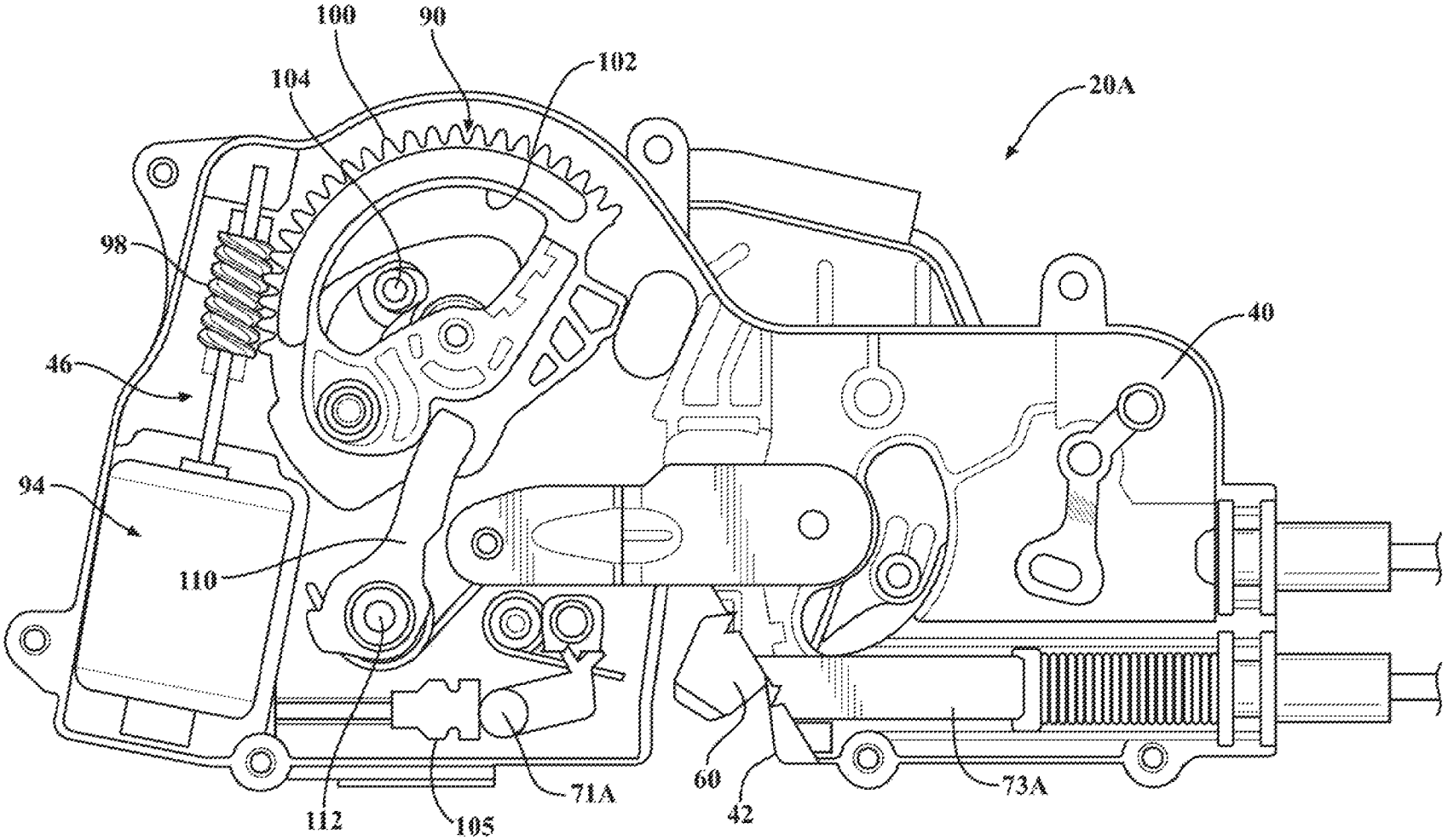

FIGS. 15F, 16F illustrate the location of actuation rod 73A when it has caused pawl 70 to be moved to its ratchet releasing position, thereby releasing latch mechanism 44 during a no-power situation or event. In this position, the pawl lug 71A has moved to the right after being pulled by the rod 73A (FIG. 16F). The PR gear 90 is shown in a non-actuated state. In this view, the lug 104 of the pawl 70 is shown having moved clockwise relative to the PR gear 90.

Figure 15G:
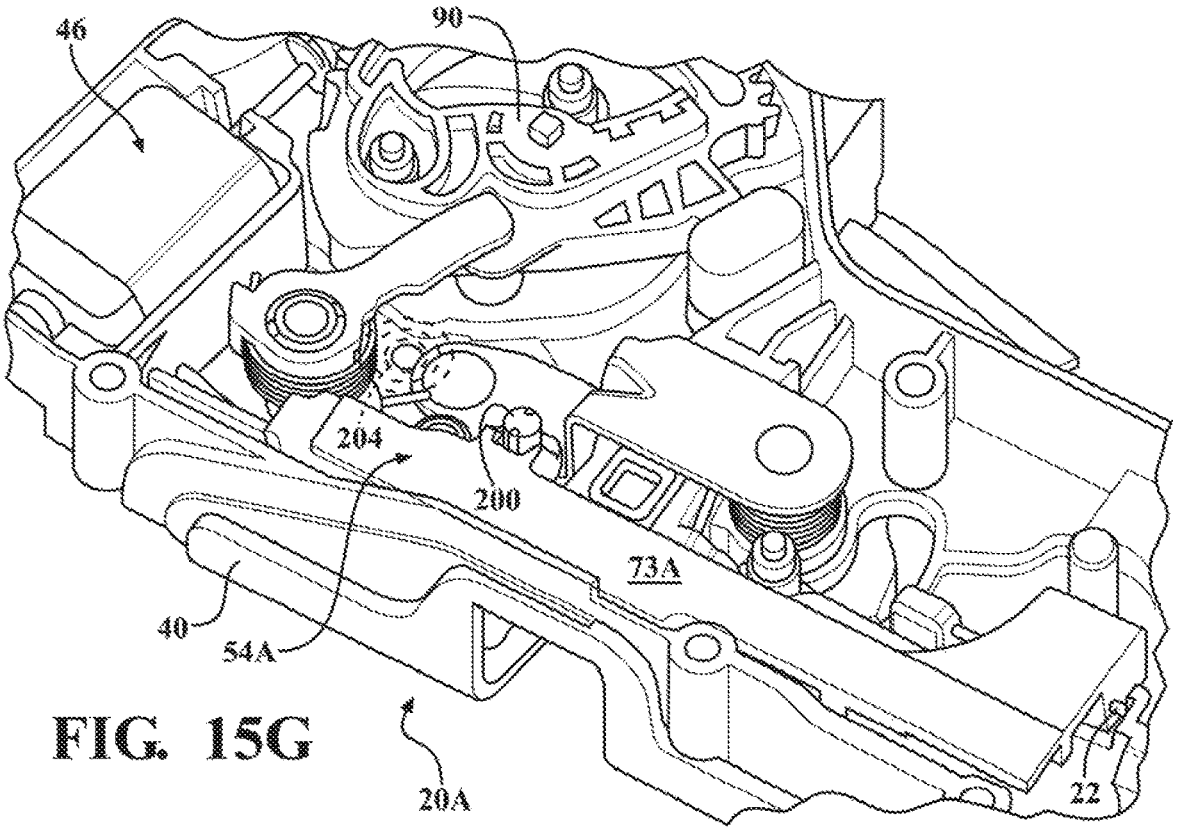
Figure 16G:
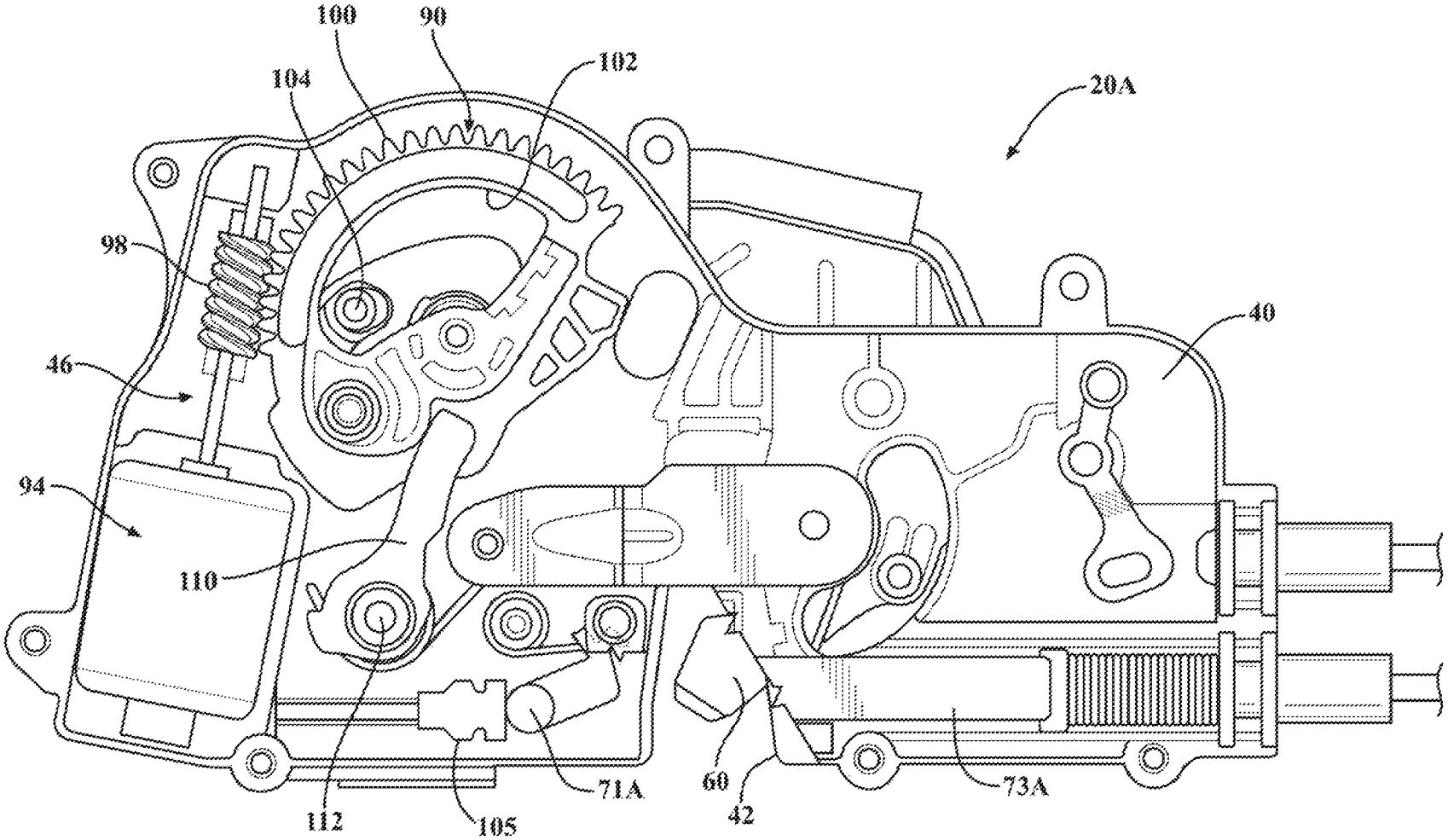

Finally, FIGS. 15G, 16G illustrate a mechanical full stop position at the end of the second range of travel when either handle 17, 24 or actuation rod 73A have reached a full travel limit via engagement with a stop. The lug 104 of the pawl 70 is shown having moved further clockwise relative to the non-actuated PR gear 90 in accordance with the rotation of the pawl 70. It will be appreciate that the reference to the lug 104 is for illustrative purposes to show how the pawl 70 has been rotated, and that in this backup operation caused by the rod 73A, that the movement of lug 104 does not have a functional purpose. It is the contact with the pawl lug 71A that provides the force on the pawl 70 to rotate the pawl 70 and release the ratchet 60 when the power release mechanism 46 is not actuated.

With the ratchet 60 released, the latch assembly 20A is in a condition where the striker 31 is released and the door may be opened, with the ratchet 60 held in an open state for subsequently receiving the striker 31 after the door is closed. The rod 73A may be released in response to releasing the handle 24 either before or after the door is opened, and the ratchet 60 will remain open. Thus, the door may be opened even after the handle 24 has been released. Releasing the handle 24 removes tension from the cable 22, allowing the bias on the rod 73A to return to the rest position. The bias on the pawl 70 likewise returns to the pawl 70 to the rest position, including the pawl lug 71A. In this above-described backup mode, the PR gear 90 has not been actuated, and therefore the PR gear 90 remains in its rest state. When the door is subsequently closed, the striker 31 will be received in the latch assembly 20A, striking the ratchet 60 and rotating the ratchet 60 back into its striker holding position. As the ratchet 60 returns to its striker holding position, the ratchet 60 will slide along the pawl 70, and the pawl 70 will then hold the ratchet 60 in the striker holding position until such time that the pawl 70 is again actuated to release the ratchet. The pawl 70 may be actuated again due to the mechanical interaction between the rod 73A and the pawl lug 71A, or by the sensor 204, or by another signal of the latch controller, if available.

Thus, the latch assembly 20A may be actuated to release the ratchet 60 based on a common kinematic connection for both the sensor-based power release actuation or the mechanical-based actuation of the pawl lug 71A. Both the power release and the mechanical release may be in response to movement of the rod 73A, with the movement either resulting in the hall sensor 204 sending a signal to actuate the PR gear 90, which rotates the pawl 70 via lug 104, or with the movement of rod 73A pulling directly on the pawl lug 71A after moving beyond the point of travel where the sensor-based actuation would have occurred.

In one example, In FIG. 16A, the actuation rod 73A may have a travel measurement of zero, and the magnet 200 may be positioned 2 mm to the left of the sensor 204 in the delivery condition. In FIG. 16B, the actuation rod 73A may have a travel measurement of 1.5 mm or 2 mm, and the magnet 200 may be positioned to the left of the sensor 204 0.5 mm in the rest position. In FIG. 16C, at a minimum power release activation position (power release at 3.5 tolerance), the actuation rod 73A has traveled 5.5 mm (4 mm from the rest position) or 7.5 mm (5.5 mm from the rest position). In FIG. 16D, at a maximum power release activation position (power release at 5.25 tolerance), the actuation rod has traveled 7.25 mm (5.75 from the rest position) or 10.2 mm (8.2 mm from the rest position). In FIG. 16E, at a first mechanical engagement with pawl 70, the actuation rod 73A has traveled 10.85 mm (9.35 mm from the rest position). Thus, there is a degree of free travel after power release before mechanical engagement. Free travel after power release at 5.25 tolerance may be 3.6 mm, and free travel after power release at 3.5 tolerance may be 5.35 mm.

In summary, the present disclosure provides a closure latch assembly equipped with a common kinematic chain for a latch release mechanism utilizing a first range of actuation travel of a handle to initiate a power release of a latch mechanism and further utilizing a subsequent, second range of actuation travel of the handle to initiate a mechanical release of the latch mechanism. In a no power situation, movement of the handle through the second range of travel provides a backup mechanical release. While closure latch assembly 20A is shown with actuation rod 73A acting directly on pawl 70, it is contemplated that an "indirect" connection configuration therebetween is also within the scope of this disclosure. For example, a latch release lever can be moveable between first and second positions in response to movement of actuation rod 73A moving between its first and second actuation positions for causing corresponding movement of pawl 70 between its ratchet holding and ratchet releasing positions. The present disclosure provides a handle-actuated latch release mechanism capable of triggering a power release of the latch mechanism in response to a first range of handle travel (i.e. handle rest position to first handle release position) and further capable of triggering a mechanical release of the latch mechanism in response to a second range of handle travel (i.e. first handle release position to second handle release position).

Figure 17:
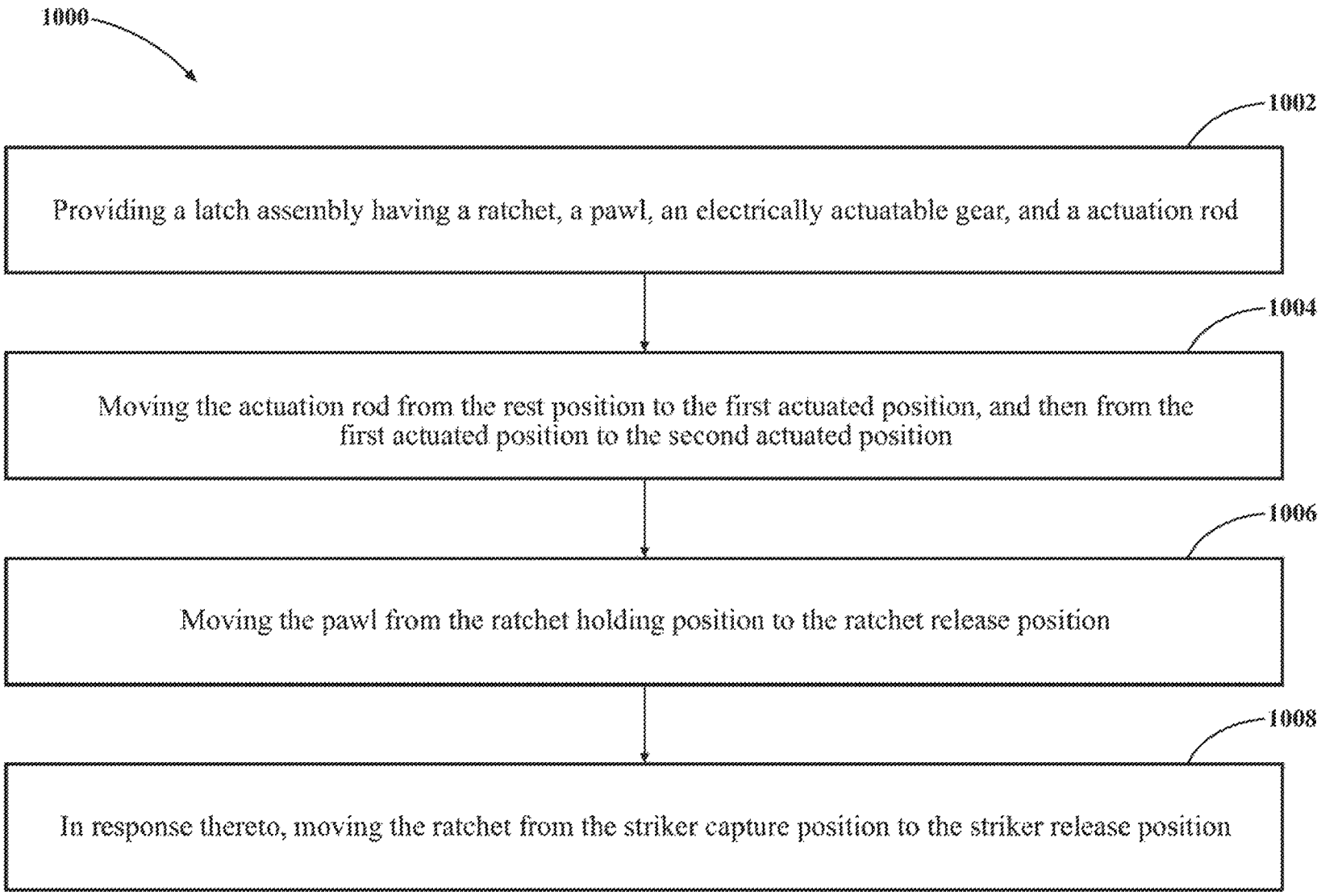
FIG. 17 illustrates a method for actuating a latch assembly, in accordance with an illustrative embodiment.

With reference to FIG. 17, there is provided an illustrative example of a method for actuating a latch assembly 1000. The method 1000 includes the steps of providing a latch assembly having a ratchet, a pawl, an electrically actuatable gear, and an actuation rod 1002, wherein the ratchet has a striker capture position and a striker release position, the ratchet being biased to the striker release position, wherein the pawl has a ratchet holding position and a ratchet release position, wherein the pawl is biased toward the ratchet holding position, wherein the gear has a rest position and an actuated position, the gear being electrically actuatable from the rest position to the actuated position, wherein the actuation rod has a rest position, a first actuated position, and a second actuated position, moving the actuation rod from the rest position to the first actuated position, and then from the first actuated position to the second actuated position 1004, moving the pawl from the ratchet holding position to the ratchet release position 1006, and in response thereto, moving the ratchet from the striker capture position to the striker release position 1008, wherein the pawl is moveable in both a normal mode and a backup mode, wherein in the normal mode, the pawl is actuated by moving the gear in response to moving the actuation rod to the first actuated position, and in the backup mode the pawl is actuated in response to moving the actuation rod to the second actuated position after moving the actuation rod to the first actuated position fails to actuate the gear. In accordance with a further embodiment of the method 1000, the actuation rod includes a magnet, and the latch assembly includes a sensor, wherein movement of the actuation rod to the first actuated position moves the magnet out of range of the sensor, wherein, in the normal mode, in response to moving the magnet out of range of the sensor, the method includes actuating the gear and moving the pawl. In accordance with yet a further embodiment of the method 1000, the pawl includes a pawl lug, wherein movement of the actuation rod to the second actuated position results in the actuation rod contacting the pawl lug and mechanically moving the pawl when operating in the backup mode, wherein the gear is not actuated by moving the actuation rod to the first actuated position.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A closure latch assembly for a vehicle door, comprising:

a latch mechanism having a ratchet moveable between a striker capture position and a striker release position, a pawl moveable between a ratchet holding position for holding the ratchet in its striker capture position and a ratchet releasing position for permitting movement of the ratchet to its striker release position, a ratchet biasing member for biasing the ratchet toward its striker release position, and a pawl biasing member for biasing the pawl toward its ratchet holding position; and a latch release mechanism having a gear operatively connected to the pawl, a power-operated actuator operable to shift the latch release mechanism from a rest position whereat the pawl is located in its ratchet holding position to an actuated position whereat the latch release mechanism has moved the pawl to its ratchet releasing position, an actuation rod operatively connected to the pawl, and a connection device operatively connecting the actuation rod to a door handle, wherein movement of the door handle from a handle rest position to a first handle release position causes movement of the actuation rod from a non-actuated position into a first actuated position, wherein the power-operated actuator is activated in response to the actuation rod being moved into the first actuation position to shift the latch release mechanism from its rest position to its actuated position, and wherein movement of the door handle from its first handle release position to a second handle release position causes movement of the actuation rod from its first actuated position into a second actuated position for causing the actuation rod to mechanically move the pawl from its ratchet holding position into its ratchet releasing position, wherein the pawl is actuated by the power-operated actuator by moving the gear in response to moving the actuation rod to the first actuation position.

2. The closure latch assembly of claim 1, wherein movement of the door handle from its handle rest position to its first handle release position defines a first range of handle movement operable to trigger actuation of the power-operated actuator to provide a power release of the latch mechanism.

3. The closure assembly of claim 2, wherein a sensor is operable to detect the location of the actuation rod in its first actuated position and provide a power release signal to a latch controller for use in triggering actuation of the power-operated actuator to shift the latch release mechanism from its rest position into its actuated position.

4. The closure latch assembly of claim 3, wherein the sensor is mounted within the closure latch assembly.

5. The closure latch assembly of claim 4, wherein the sensor is a Hall sensor configured to detect a magnet mounted to the actuation rod in response to movement between its non-actuated and first actuated positions.

6. The closure latch assembly of claim 2, wherein movement of the door handle from its first handle release position to its second handle release position defines a second range of handle travel movement operable to cause the actuation rod to move the pawl from its ratchet holding position to its ratchet releasing position to provide a mechanical release of the latch mechanism.

7. The closure latch assembly of claim 6, wherein the actuation rod engages the pawl when it is located in its second actuated position and forcibly drives the pawl from its ratchet holding position into its ratchet releasing position in response to movement of the actuation rod from its first actuated position into its second actuated position.

8. The closure latch assembly of claim 1, the power-operated actuator operable to rotate the gear from a gear rest position whereat the pawl is located in its ratchet holding position to a gear actuated position whereat the latch release mechanism gear has moved the pawl to its ratchet releasing position, wherein the pawl is overlaid with respect to the gear and includes a first drive lug retained in a drive slot formed in the gear and wherein the drive slot is configured to drive the pawl from its ratchet holding position to its ratchet releasing position in response to rotation of the gear from its gear rest position to its gear actuated position.

9. The closure latch assembly of 8, wherein the pawl further includes a second drive lug retained in a drive chamber formed in the actuation rod and configured to drive the pawl from its ratchet holding position to its ratchet releasing position in response to movement of the actuation rod from its first actuated position into its second actuated position.

10. The closure latch assembly of claim 1, wherein the connection device is a bowden cable having a first end coupled to the actuation rod and a second end coupled to the door handle.

11. The closure latch assembly of claim 1, wherein the actuation rod is normally biased toward its non-actuated position.

12. The closure latch assembly of claim 1, wherein the actuation rod is supported for a sliding translational movement relative to the latch housing.

13. A closure latch assembly for a vehicle door, comprising:

a latch mechanism having a ratchet moveable between a striker capture position and a striker release position, the ratchet biased toward the striker release position;

a pawl moveable between a ratchet holding position for holding the ratchet in its striker capture position and a ratchet releasing position for permitting movement of the ratchet to its striker release position, the pawl biased to the ratchet holding position;

a latch release mechanism having a gear configured to act on the pawl to move the pawl from the ratchet holding position to the ratchet releasing position;

a power-operated actuator operable to rotate the gear from a gear rest position whereat the pawl is located in its ratchet holding position to a gear actuated position whereat the gear has moved the pawl to its ratchet releasing position, an actuation rod configured to contact the pawl to move the pawl from the ratchet holding position to the ratchet release position, the actuation rod moveable from a rest position, a first actuation position, and a second actuation position;

a sensor associated with the actuation rod, wherein, when the sensor operates in a normal mode, the sensor is configured to signal when the actuation rod is in the first actuation position, and rotation of the gear causes movement of the pawl;

wherein, movement of the actuation rod from its first actuation position into a second actuation position causes the actuation rod to contact the pawl and mechanically move the pawl from its ratchet holding position into its ratchet releasing position;

wherein the actuation rod includes a magnet detectable by the sensor.

14. The closure latch assembly of claim 13, wherein the sensor comprises a hall sensor.

15. The closure latch assembly of claim 14, wherein in the rest position of the actuation rod, the magnet is disposed within a range of the hall sensor.

16. The closure latch assembly of claim 15, wherein in the first actuated position of the actuation rod, the magnet is out of the range of the hall sensor, and the actuation rod is not in contact with the pawl.

17. The closure latch assembly of claim 16, wherein in the second actuated position of the actuation rod, the magnet is out of the range of the hall sensor, and the actuation rod is in contact with the pawl.

18. A method for actuating a latch assembly, the method comprising:

providing a latch assembly having a ratchet, a pawl, an electrically actuatable gear, and an actuation rod;

wherein the ratchet has a striker capture position and a striker release position, the ratchet being biased to the striker release position;

wherein the pawl has a ratchet holding position and a ratchet release position, wherein the pawl is biased toward the ratchet holding position;

wherein the electrically actuatable gear has a rest position and an actuated position, the gear being electrically actuatable from the rest position to the actuated position;

wherein the actuation rod has a rest position, a first actuated position, and a second actuated position;

moving the actuation rod from the rest position to the first actuated position, and then from the first actuated position to the second actuated position;

moving the pawl from the ratchet holding positon to the ratchet release position;

in response thereto, moving the ratchet from the striker capture position to the striker release position;

wherein the pawl is moveable in both a normal mode and a backup mode, wherein in the normal mode, the pawl is actuated by moving the gear in response to moving the actuation rod to the first actuated position, and in the backup mode the pawl is contacted by the actuation rod and actuated in response to moving the actuation rod to the second actuated position after moving the actuation rod to the first actuated position.

19. The method of claim 18, wherein the actuation rod includes a magnet, and the latch assembly includes a sensor, wherein movement of the actuation rod to the first actuated position moves the magnet out of range of the sensor, wherein, in the normal mode, in response to moving the magnet out of range of the sensor, the method includes actuating the gear and moving the pawl.

20. The method of claim 19, wherein the pawl includes a pawl lug, wherein movement of the actuation rod to the second actuated position results in the actuation rod contacting the pawl lug and mechanically moving the pawl when operating in the backup mode, wherein the gear is not actuated by moving the actuation rod to the first actuated position.

* * * * *